US010299587B2

(12) United States Patent
Stuffel et al.

(10) Patent No.: US 10,299,587 B2
(45) Date of Patent: May 28, 2019

(54) DEVICE AND METHOD FOR FIXING A MOVABLE FURNITURE PART

(71) Applicant: PAUL HETTICH GMBH & CO. KG, Kirchlengern (DE)

(72) Inventors: Andreas Stuffel, Bueckeburg (DE); Marvin Buhmeier, Petershagen (DE)

(73) Assignee: Paul Hettich GmbH & Co. KG, Kirchlengem (DE)

( * ) Notice: Subject to any disclaimer, the term of this patent is extended or adjusted under 35 U.S.C. 154(b) by 0 days.

(21) Appl. No.: 15/569,151

(22) PCT Filed: May 3, 2016

(86) PCT No.: PCT/EP2016/059887
§ 371 (c)(1),
(2) Date: Oct. 25, 2017

(87) PCT Pub. No.: WO2016/177730
PCT Pub. Date: Nov. 10, 2016

(65) Prior Publication Data

US 2018/0140095 A1 May 24, 2018

(30) Foreign Application Priority Data

May 4, 2015 (DE) ..... 10 2015 106 873

(51) Int. Cl.
*A47B 88/00* (2017.01)
*A47B 88/427* (2017.01)
*A47B 88/407* (2017.01)

(52) U.S. Cl.
CPC ..... *A47B 88/427* (2017.01); *A47B 88/407* (2017.01); *A47B 2088/4272* (2017.01);
(Continued)

(58) Field of Classification Search
CPC ..... A47B 88/427; A47B 88/403; A47B 96/06; A47B 88/407; A47B 88/40; A47B 88/423
(Continued)

(56) References Cited

U.S. PATENT DOCUMENTS 5,588,729 A * 12/1996 Berger ..... A47B 88/427 312/330.1
5,737,820 A 4/1998 Ferrari et al.
(Continued)

FOREIGN PATENT DOCUMENTS

AT 506879 * 12/2009
AT 508 544 A4 2/2011
(Continued)

OTHER PUBLICATIONS

International Search Report of PCT/EP2016/059888, dated Jul. 26, 2016.
(Continued)

*Primary Examiner* — Janet M Wilkens
(74) *Attorney, Agent, or Firm* — Collard & Roe, P.C.

(57) ABSTRACT

A device for fixing a push element, in particular a drawer box to a rail of a pull-out guide, the device comprising a clamping mechanism with a receptacle, into which a web-shaped holding part can be inserted, wherein a self-locking clamping element is provided at the receptacle, by means of which the holding part is secured in a clamping manner against being pulled out. As a result, a particularly stable fixation of the drawer box to a pull-out guide can be achieved.

21 Claims, 20 Drawing Sheets

(52) U.S. Cl.
CPC ..... *A47B 2088/4274* (2017.01); *A47B 2088/4276* (2017.01); *A47B 2088/4278* (2017.01); *A47B 2210/0056* (2013.01); *A47B 2230/0014* (2013.01)

(58) Field of Classification Search
USPC ..... 312/334.7, 223.1, 334.4, 334.5, 348.1, 312/348.2, 334.6, 333; 384/22
See application file for complete search history.

(56) References Cited

U.S. PATENT DOCUMENTS

| | | | | |
|---|---|---|---|---|
| 6,913,334 | B2 | 7/2005 | Weichelt | |
| 8,056,994 | B2 * | 11/2011 | Chen | A47B 88/427 312/334.14 |
| 8,424,984 | B2 | 4/2013 | Ritter | |
| 8,727,460 | B2 | 5/2014 | Grabher | |
| 8,764,136 | B2 * | 7/2014 | Grabherr | A47B 88/427 312/334.27 |
| 8,854,769 | B1 * | 10/2014 | Liang | A47B 88/427 360/125.51 |
| 9,066,587 | B1 * | 6/2015 | Liang | A47B 88/0422 |
| 9,259,087 | B1 * | 2/2016 | Hsiao | A47B 88/0055 |
| 9,808,083 | B2 * | 11/2017 | Lucas | A47B 88/427 |
| 9,986,829 | B2 * | 6/2018 | McGregor | A47B 88/427 |
| 2003/0234603 | A1 * | 12/2003 | Salice | A47B 88/407 312/334.5 |
| 2004/0095047 | A1 * | 5/2004 | Salice | A47B 88/427 312/332.1 |
| 2004/0227440 | A1 * | 11/2004 | Booker | F16F 9/0218 312/334.1 |
| 2008/0218045 | A1 * | 9/2008 | Moser | A47B 88/427 312/333 |
| 2013/0113356 | A1 * | 5/2013 | Salice | A47B 88/0422 312/334.44 |
| 2013/0257244 | A1 * | 10/2013 | Salice | A47B 88/0418 312/319.1 |
| 2014/0015390 | A1 * | 1/2014 | Grabherr | A47B 88/04 312/334.4 |
| 2014/0175965 | A1 * | 6/2014 | Salice | A47B 88/04 312/334.1 |
| 2014/0210330 | A1 * | 7/2014 | Amann | A47B 88/0422 312/334.1 |
| 2014/0314347 | A1 | 10/2014 | Huang | |
| 2015/0147008 | A1 * | 5/2015 | McGregor | A47B 88/0422 384/22 |
| 2016/0025124 | A1 * | 1/2016 | Roedder | F16B 12/04 403/14 |
| 2016/0128476 | A1 * | 5/2016 | Ng | A47B 88/16 312/333 |
| 2017/0105525 | A1 | 4/2017 | Klaus | |
| 2017/0347794 | A1 * | 12/2017 | McGregor | A47B 88/49 |
| 2018/0140095 | A1 * | 5/2018 | Stuffel | A47B 88/427 |
| 2018/0146782 | A1 * | 5/2018 | Boekhoff | A47B 88/427 |
| 2018/0146783 | A1 * | 5/2018 | Stuffel | A47B 88/427 |

FOREIGN PATENT DOCUMENTS

| | | | |
|---|---|---|---|
| AT | 510714 | * | 6/2012 |
| AT | 512748 | * | 10/2013 |
| AT | 518136 | * | 7/2017 |
| DE | 4301327 | * | 8/1993 |
| DE | 696 14 443 | T2 | 5/2002 |
| DE | 20 2004 001 791 | U1 | 5/2004 |
| DE | 20 2009 017 319 | U1 | 5/2011 |
| DE | 202009013706 | * | 5/2011 |
| DE | 20 2010 007 765 | U1 | 11/2011 |
| DE | 202011004588 | * | 7/2012 |
| DE | 10 2011 000 724 | A1 | 8/2012 |
| DE | 10 2013 104 829 | A1 | 11/2014 |
| DE | 10 2013 104 830 | A1 | 11/2014 |
| DE | 102013104829 | * | 11/2014 |
| DE | 21 2013 000 112 | U1 | 12/2014 |
| DE | 10 2014 104 136 | A1 | 10/2015 |
| EP | 606564 | * | 7/1994 |
| EP | 695523 | * | 2/1996 |
| EP | 1 285 604 | B1 | 10/2005 |
| JP | 2004160224 | * | 6/2004 |
| WO | 2007118632 | * | 10/2007 |
| WO | 2009/149479 | A1 | 12/2009 |
| WO | 2010040273 | * | 4/2010 |
| WO | 2010129303 | * | 11/2010 |
| WO | 2011094776 | * | 8/2011 |
| WO | 2012092634 | * | 7/2012 |
| WO | 2014065523 | * | 5/2014 |
| WO | 2014/180899 | A1 | 11/2014 |
| WO | 2015/120493 | A1 | 8/2015 |

OTHER PUBLICATIONS

German Search Report in DE 10 2015 106 856.7 dated Mar. 8, 2016 with English translation of relevant parts.
International Search Report of PCT/EP2016/059887, dated Jul. 26, 2016.
German Search Report in DE 10 2015 106 873.7 dated Mar. 9, 2016 with English translation of relevant parts.
International Search Report in PCT/EP2016/059886, dated Jul. 26, 2016.
German Search Report in DE 10 2015 106 855.9 dated Mar. 8, 2016 with English translation of relevant parts.
International Search Report in PCT/EP2016/059890, dated Jul. 26, 2016.
German Search Report in DE 10 2015 106 852.4 dated Feb. 26, 2016 with English translation of relevant parts.
International Search Report in PCT/EP2016/059885, dated Jul. 26, 2016.
German Search Report in DE 10 2015 106 854.0 dated Feb. 29, 2016 with English translation of relevant parts.

* cited by examiner

DEVICE AND METHOD FOR FIXING A MOVABLE FURNITURE PART

CROSS REFERENCE TO RELATED APPLICATIONS

This application is the National Stage of PCT/EP2016/059887 filed on May 3, 2016, which claims priority under 35 U.S.C. § 119 of German Application No. 10 2015 106 873.7 filed on May 4, 2015, the disclosures of which are incorporated by reference. The international application under PCT article 21(2) was not published in English.

BACKGROUND OF THE INVENTION

The present invention relates to a device for fixing a movable furniture part, in particular a drawer, on a rail of a pullout guide, comprising a clamping mechanism having a receptacle in which a web-shaped holding part is insertable, wherein a self-locking clamping lever is provided on the receptacle, by means of which the holding part is secured in a friction-locked manner against being pulled out, and a method for securing a movable furniture part.

EP 1 285 604 discloses a device for fixing a drawer on a rail of a pullout guide, in which a base part fastenable on the drawer and a catch element fixable on the pullout guide are provided. The catch element is displaceable in relation to the base part within certain tolerances for a compensation of the distance of the guide rail of the pullout guides. Due to the formation of the catch element and the base part as plastic parts, the holding forces are limited, in particular in the case of heavy drawers, which are moved in the pullout direction up to the maximum pullout position. In addition, it is desirable to position the drawers as exactly as possible within the furniture body to obtain an appealing front panel alignment.

WO 2009/149479 discloses a device for the detachable coupling of a drawer to a pullout guide, in which a holding part and a counter holding part are connected to one another via an elastic material piece. This results in a reduction of the position accuracy in the longitudinal direction. In the lateral direction, the drawer can be fixed via a catch device on the rail. In the standardized impact tests for drawers, in which the drawers are pulled out with load, however, only comparatively low holding forces of such a catch connection result.

SUMMARY OF THE INVENTION

It is therefore the object of the present invention to provide a device and a method for fixing a movable furniture part, in which high holding forces can be provided.

This object is achieved by a device and a method according to the invention as described below.

The device according to the invention for fixing a movable furniture part comprises a clamping mechanism having a receptacle, into which a web-shaped holding part is insertable, wherein a self-locking clamping lever is provided on the receptacle, by means of which the holding part is secured in a friction-locked manner against being pulled out. Particularly stable fixing of the movable furniture part can thus be performed via the self-locking clamping lever. The self-locking clamping lever of the clamping mechanism ensures fixing of the holding part such that it cannot be pulled out further in the opening direction from the receptacle. Inserting the holding part into the receptacle of the clamping mechanism is comparatively simple, in contrast, since only slight friction forces have to be overcome, so that the installation can be made simple. In addition, continuous fixing of the holding part can be caused by a friction-locked connection of the clamping lever, which enables particularly accurate positioning of the push element in the opening direction. The movable furniture part can be designed as a drawer, but also as a sliding door, movable front panel, or as a pivotable door or flap.

A friction-locked or non-positive connection according to the invention differs from a formfitting connection in that the holding forces are provided by friction forces and not by formfitting stop elements, such as teeth or stops. A continuous adjustment, which is independent of stop elements, can thus be obtained with a friction-locked fixing of the holding part.

The web-shaped holding part can have a substantially flat surface for the friction-locked connection, which is regionally in contact with a contact surface on the clamping lever. The holding part can be produced as strip-shaped, angled, U-shaped, as a hollow profile, or having other geometries, in particular from metal, wherein a section of a profile can be used for the friction-locked connection. The holding part can also be formed by a section of the fitting profile.

The clamping lever is preferably mounted so it is rotatable about a rotational axis. Alternatively, a pivotable mounting about a bending edge can also be provided. In this case, the clamping lever can be pre-tensioned in a locked position via a force accumulator, in particular via one or more springs.

According to one preferred embodiment of the invention, means are provided for unlocking the clamping lever, by means of which the non-positive connection of the clamping lever can be disengaged from the holding part. A linearly movable slide or a button can be provided for unlocking the clamping lever. In this case, the clamping lever can be formed as a two-armed lever, wherein a first arm presses with a contact surface against the holding part and a second arm is movable via the means for unlocking the clamping lever. By setting the length of the lever arms, corresponding force transmission ratios can be caused, wherein the contact surface only has to be moved slightly away from the holding part to unlock the clamping lever. Instead of a slide, a pivotable lever or a traction element can also be provided for the unlocking.

The clamping lever preferably presses via a linear contact surface, which extends in parallel to the rotational axis of the clamping lever, against the holding part. The contact surface can be formed as sharp-edged, rounded, or having another contact contour in this case, to provide high clamping forces. The high clamping forces are generated in this clamping system by a force multiplication by the lever effect.

The holding part can preferably be continuously fixed on the clamping mechanism, so that during the installation, the drawer is placed on the pullout guide and pushed in slightly, and as soon as the holding part is fixed on the clamping mechanism, the installer has certainty that the drawer cannot slip unintentionally from the pullout guide in the opening direction as it is pulled out. Rather, the clamping mechanism is activated as soon as the holding part is guided past the clamping lever in the receptacle. Subsequent further pushing in of the drawer for a continuous adjustment is possible without problems in this case.

For particularly stable fastening of the drawer, the holding part and the contact surface of the clamping lever pressing against the holding part can be produced from metal, for example, from a steel plate. In contrast to metal, plastic flows, so that only lesser forces can be absorbed via the clamping mechanism, wherein the use of plastics, in particular reinforced plastics, is entirely possible.

The rotational axis of the clamping lever is preferably arranged in front of a contact surface of the clamping lever on the holding part in the insertion direction. Self-locking is thus caused, wherein in the installed position, an angle between the contact surface of the clamping lever in relation to the rotational axle can be arranged at an angle in relation to the longitudinal direction of the holding part between 55° and 89°, in particular 70° to 85°. The free running direction and the blocking direction in the clamping system are defined by the angle position of the clamping lever. If the holding part is loaded in the blocking direction, a self-reinforcing effect occurs, so that with increased load of the holding part in the blocking direction, the clamping force also increases.

For simple installation, the receptacle can be formed on the fastening part, on which the clamping lever is mounted so it is rotatable. The clamping lever can then be preinstalled with the receptacle as a unit on the rail or the drawer. The fastening part is preferably mounted so it is displaceable on or in a housing. The fastening part can thus be moved via means for lateral adjustment in relation to the housing, so that an exact alignment of the drawer is also possible perpendicularly to the movement direction of the pullout guide in the horizontal direction. A height adjustment and/or a depth adjustment can also be provided.

In a method for aligning a movable furniture part on a component of a fitting in a furniture part, such as a furniture body, at least one clamping mechanism having a receptacle for at least one holding part and at least one unit for adjustment for the movable furniture part are provided. The movable furniture part is placed on the fitting and then pushed up to the setting position on the furniture part. The adjustment is then set so that the clamping mechanism cannot be pushed further onto the holding part, so that the pushing-in depth is set via the stop.

BRIEF DESCRIPTION OF THE DRAWINGS

The invention will be explained in greater detail hereafter on the basis of an exemplary embodiment with reference to the appended drawings. In the figures.

DETAILED DESCRIPTION OF THE INVENTION

Figure 1:
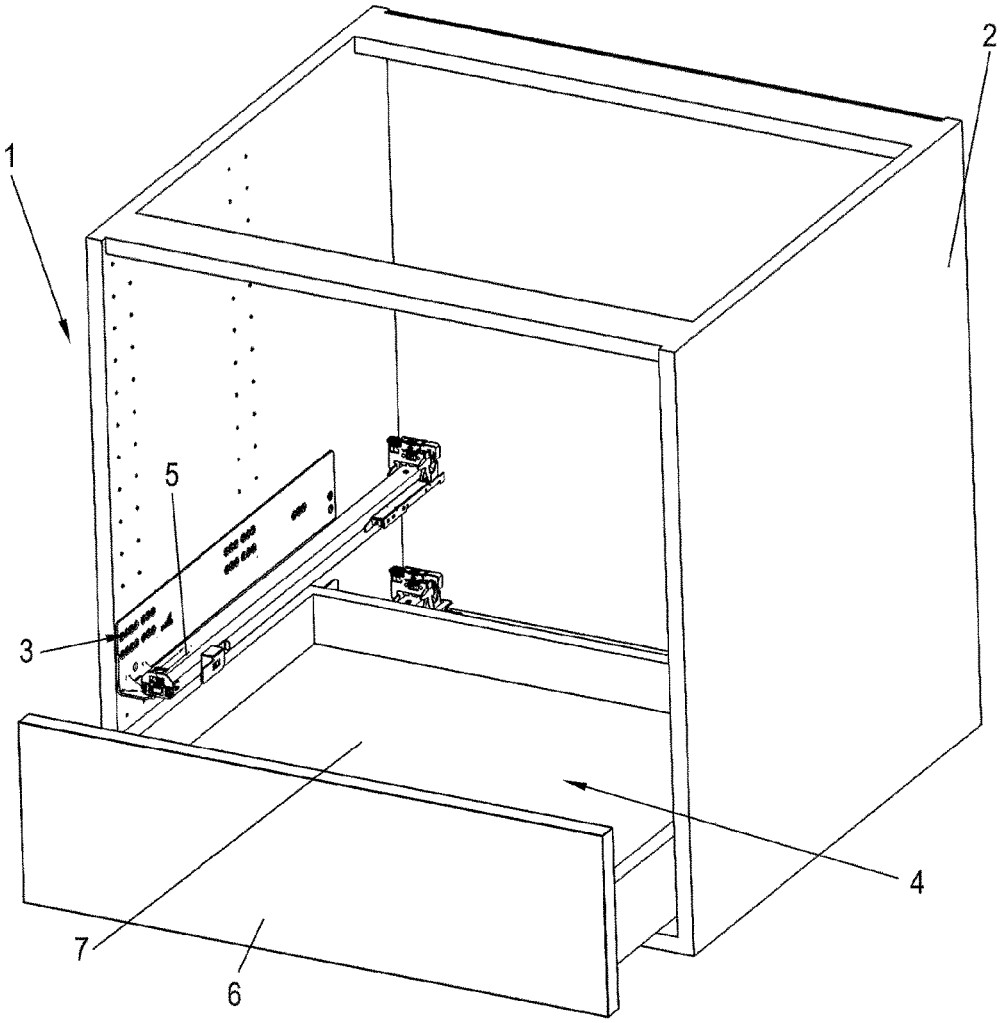
FIG. 1 shows a perspective view of an item of furniture having a drawer.
Figure 2:
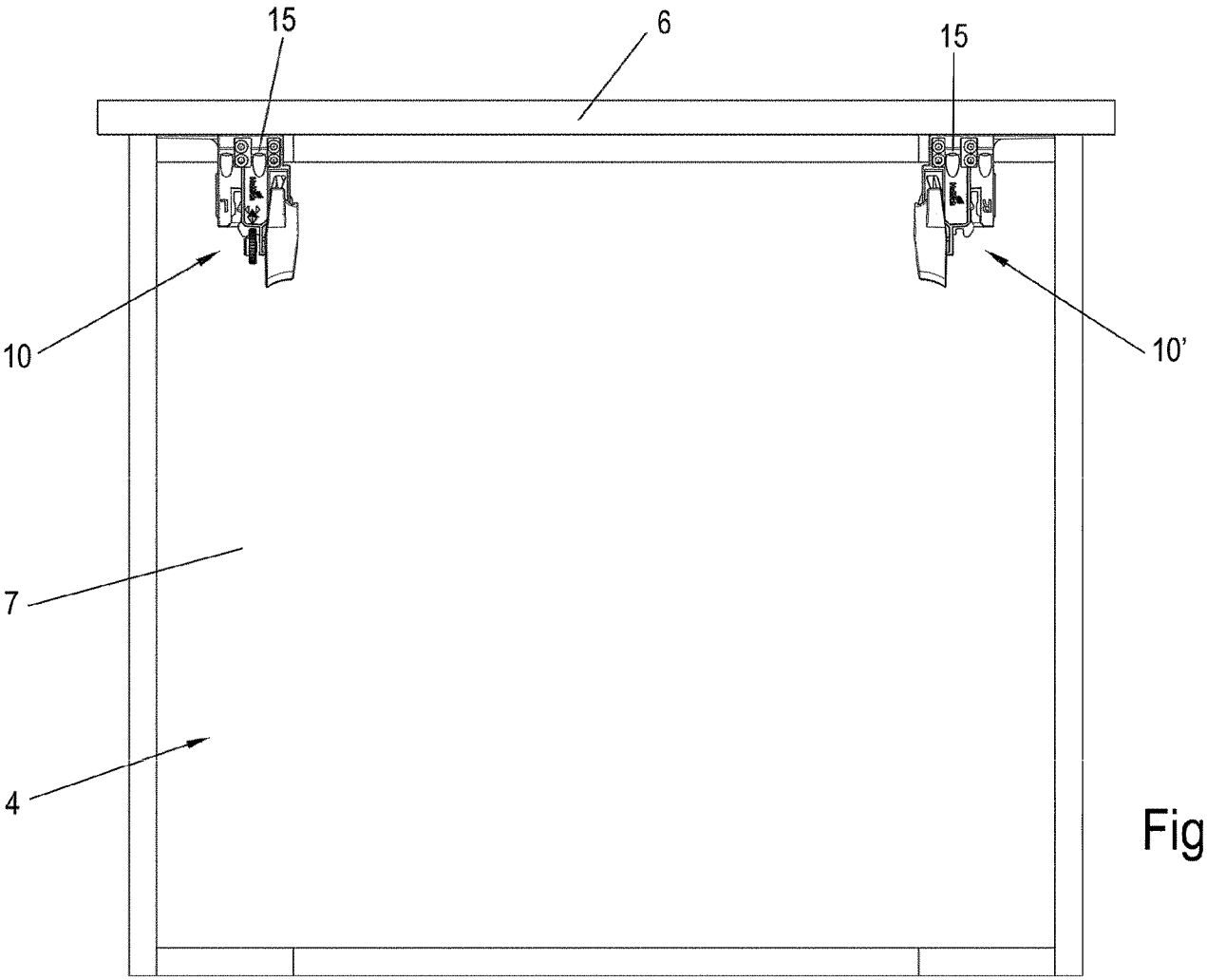
FIG. 2 shows a bottom view of the drawer of FIG. 1.

An item of furniture 1 comprises a furniture body 2, on the side walls of which one or more pullout guides 3 are fixed, which have at least one movable rail 5. A drawer 4 is held so it is movable on two such rails 5, wherein a device 10 or 10', respectively, for fixing the drawer 4 on the rail 5 is provided for this purpose on each rail 5, as is recognizable from the bottom view of FIG. 2. A first device 10 having lateral adjustment for fixing the drawer 4 and a second device 10' without lateral adjustment for fixing the drawer are fixed on a rail 5 on a bottom 7 of the drawer 4. Each device 10 and 10' comprises a housing 15 in this case, which is fixed on a front panel 6 and/or the bottom 7 of the drawer 4.

Figure 3:
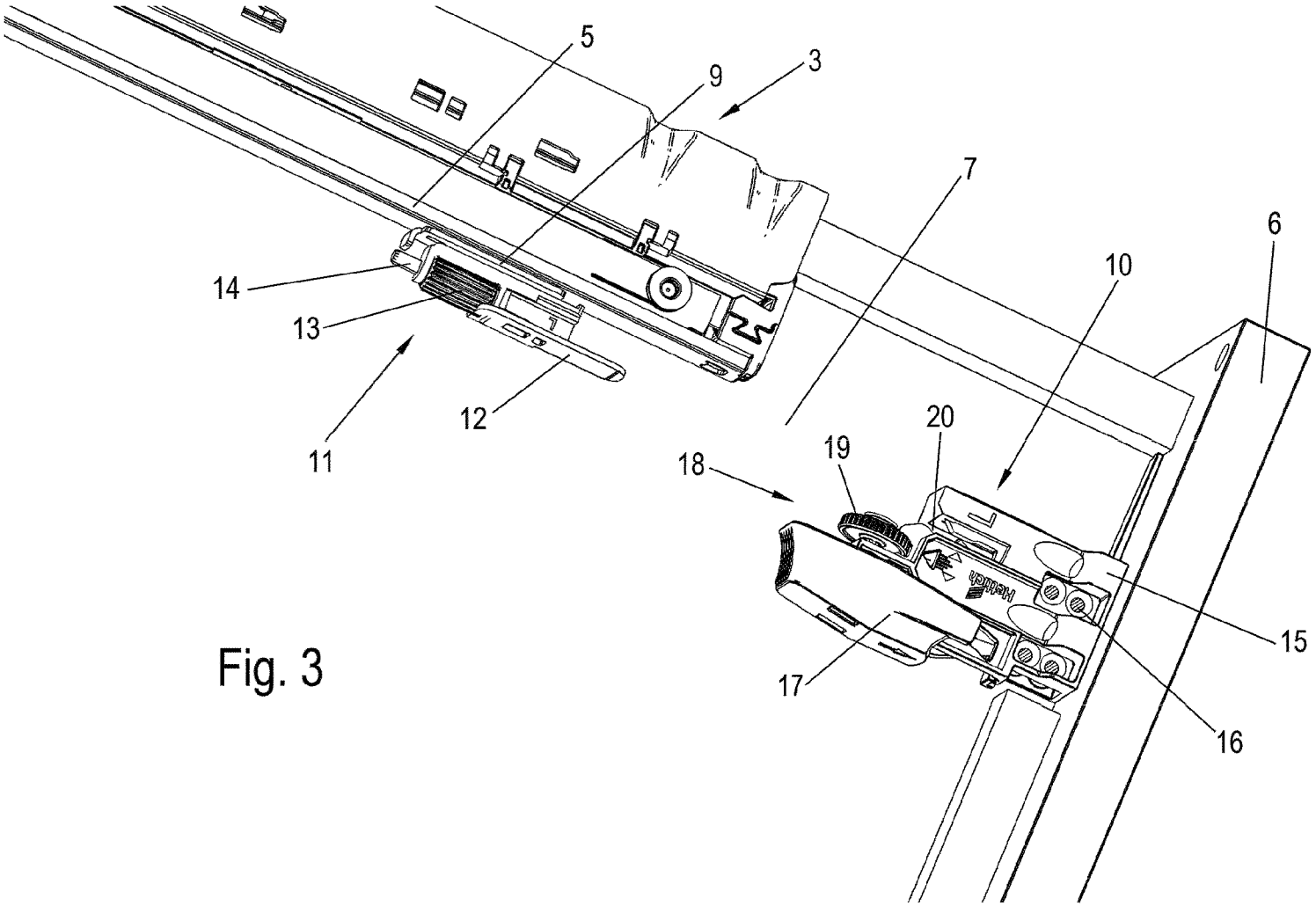
FIG. 3 shows a perspective detail illustration of the device according to the invention for fixing the drawer.

In the detail view of FIG. 3, the device 10 is shown during the installation. The housing 15 can be fixed via fastening means 16 on the lower side of the drawer 4, wherein a receptacle 20 is provided for inserting a holding part 12. The holding part 12 is held on the rail 5 of the pullout guide 3. In this case, the web-shaped holding part 12 can optionally be fixed via an integrally formed tab 9 on the rail 5, for example, by welding, or can be fixed on the rail 5 via further components, or the holding part 12 is a part of the rail profile of the rail 5. A unit 11 for depth adjustment is provided on the tab 9, which has a rotationally-fixed threaded bolt 14, on which a knurled nut 13 is mounted so it is rotatable, but axially immovable. The threaded bolt 14 can thus be moved in the longitudinal direction of the rail 5 by rotating the knurled nut 13 and can therefore move a stop which specifies the maximum insertion depth of the holding part 12 into the receptacle 20. Such a unit 11 for depth adjustment can optionally also be omitted.

For the installation, the drawer 4 is placed on the two rails 5 of the two pullout guides 3 and pushed into the closed position. In this case, a web-shaped holding part 12 is inserted into the receptacle 12 of the device 10 or 10', respectively, on each of the opposing sides and fixed via a clamping mechanism, which secures the holding part 12 in a clamping and friction-locked manner against pulling out.

Figure 4:
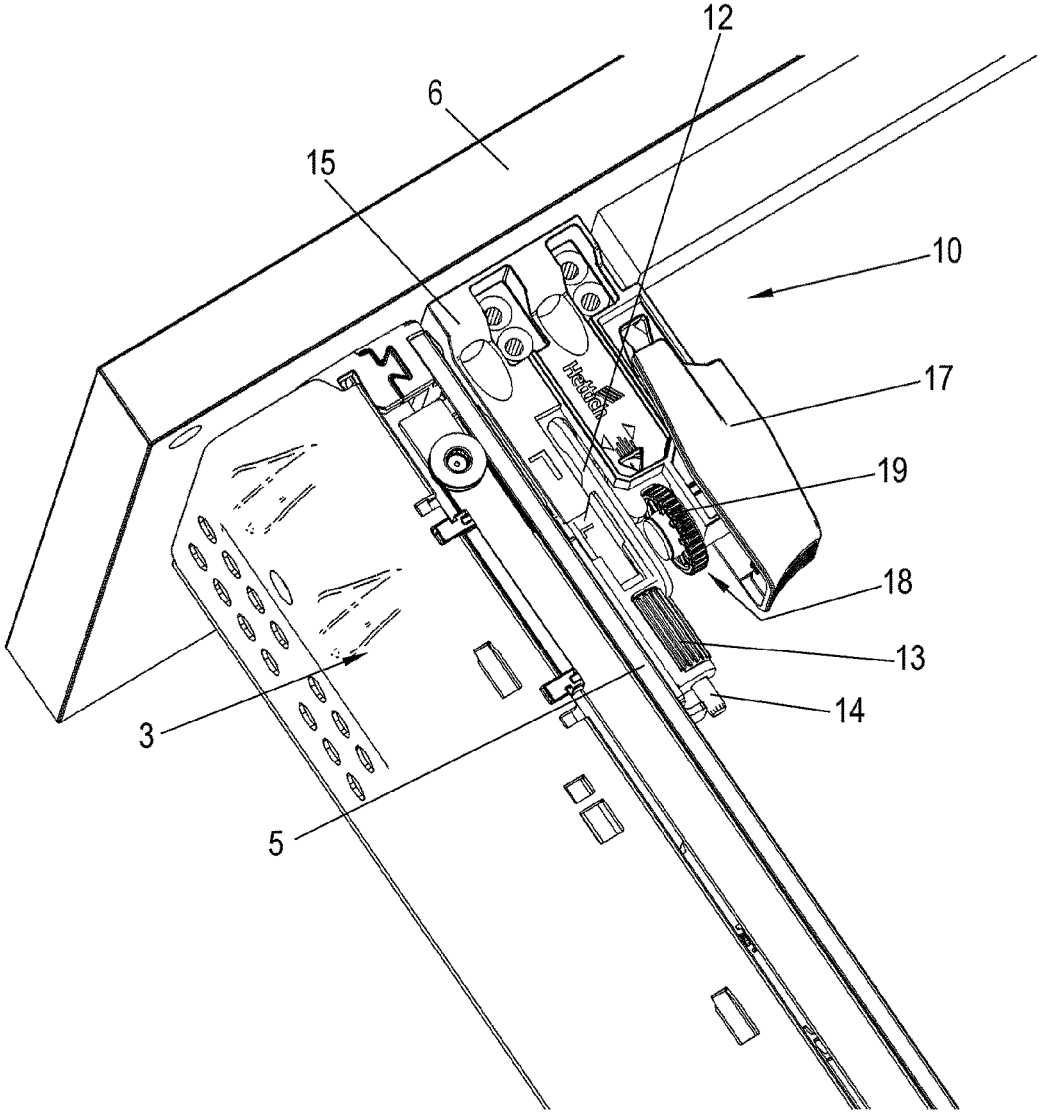
FIG. 4 shows a perspective view of the device of FIG. 3 in the installed position.

FIG. 4 shows the installed position of the drawer 4. The holding part 12 has been inserted into the receptacle 20 and secured therein against pulling out. The lateral front panel alignment can now be adapted via a unit 18 for lateral adjustment. The unit 18 for lateral adjustment comprises a knurled nut 19, which causes, by way of rotation, the housing 15 to be moved laterally in relation to the receptacle 20 in the horizontal direction, to perform a lateral adjustment.

Figure 5:
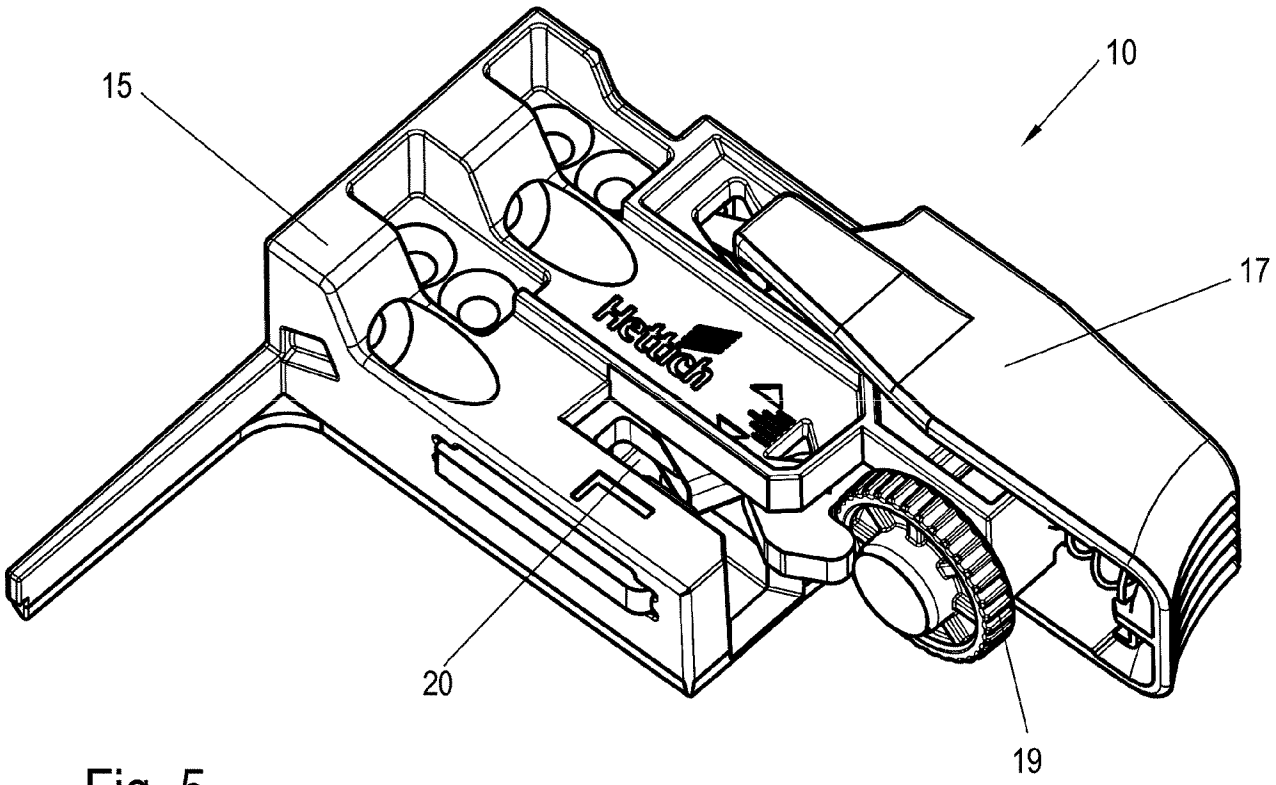
FIG. 5 shows a perspective view of the device without drawer before the installation.

FIG. 5 shows the device 10 without holding part 12. The device 10 comprises a slide 17, which is used for unlocking the clamping mechanism. The drawer 4 can thus be removed again after the installation upon actuation of the slide 17.

Figure 6:
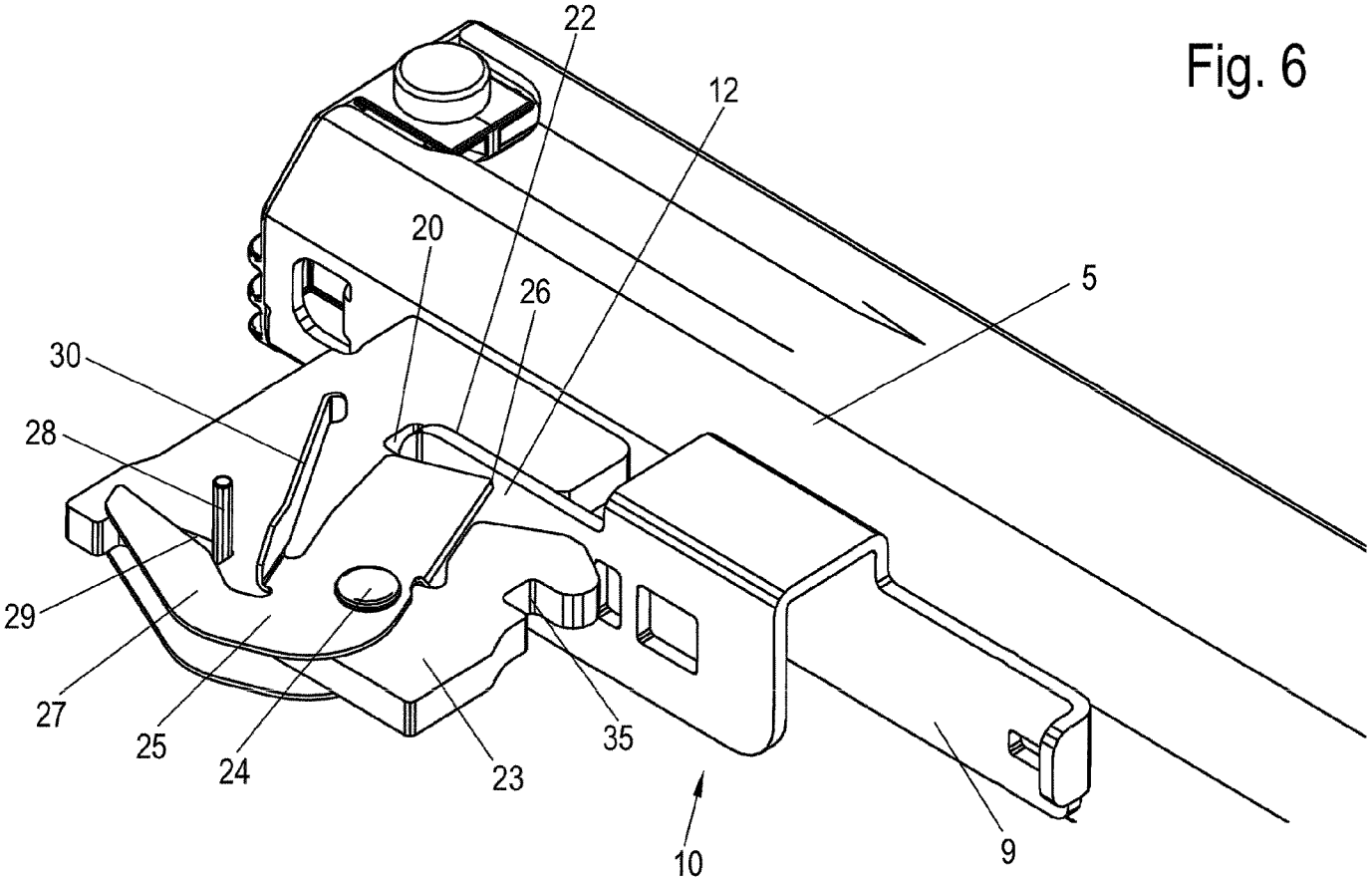
FIG. 6 shows a perspective view of the device without housing during the installation.

FIG. 6 shows the device 10 without the housing 15, but with the holding part 12, which is fixed by clamping in the receptacle 20.

The clamping mechanism comprises a clamping lever 25, which is mounted on a fastening part 23 so it is rotatable about a bolt-shaped rotational axis 24. The fastening part 23 is plate-shaped and forms a side wall 22 of the receptacle 20, which is arranged opposite to the clamping lever 25. The holding part 12 is fixed by clamping in a friction-locked manner between a contact surface 26 of the clamping lever 25 and the side wall 22 and secured against pulling out. For this purpose, the rotational axis 24 is arranged in front of the contact surface 26 viewed in the insertion direction of the holding part 12, so that the holding part 12, upon insertion into the receptacle 20, firstly passes a plane perpendicular to the insertion direction in which the rotational axis 24 is arranged, before the holding part 12 touches the contact surface 26. The clamping lever 25 is thus made self-locking and in the event of traction forces on the holding part 12, the clamping lever 25 having the surface 26 is pressed even more strongly against the holding part 12.

The clamping lever 25 is designed as a two-armed lever, wherein the contact surface 26 for the clamping fixing of the holding part 12 is formed on one arm and means for unlocking the clamping lever 25 engage on a second arm. The clamping lever 25 is formed angled in this case and is pre-tensioned by an integrally formed spring 30 in the clamping position. The spring 30 is designed in this case as a leaf spring and is supported on the housing 15. The means for unlocking comprise a bolt 28, which is formed so it is displaceable in a wedge-shaped gap 29 between the arm 27 and the fastening part 23. If the bolt 28 is pushed toward the end of the arm 27, the arm 27 is moved by the wedge-shaped formation of the gap 29 and the clamping lever 25 rotates such that the contact surface 26 disengages from the holding part 12. The holding part 12 can thus be pulled out easily after rotation of the clamping lever 25. The bolt 28 is guided in this case along a side wall of the fastening part 23.

The clamping lever 25 is produced in this case from a bent metal plate, which encloses a section of the plate-shaped fastening part 23 in a U shape. The bottom of the U is formed on the contact surface 26 in this case, so that a linear contact surface 26 presses against the holding part 12.

Figure 7:
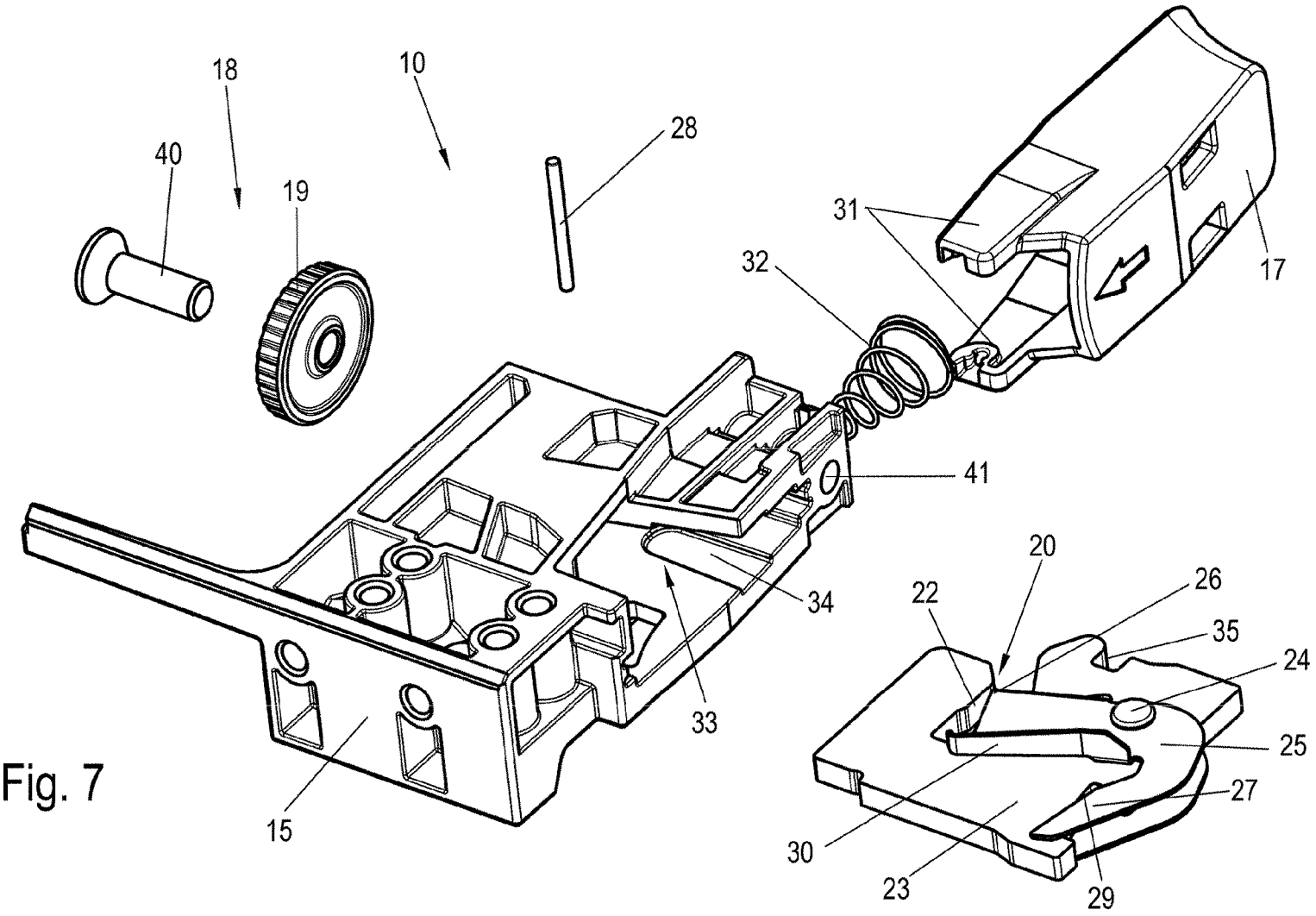
FIGS. 7 to 9 show multiple views of the device for fixing a push element without holding part.

FIG. 7 shows an exploded illustration of the device 10 having the housing 15. A slotted receptacle 33 is provided on the housing 15, on which the fastening part 23 having the clamping lever 25 is held so it is displaceable. A head section on the rotational axis 24 is guided in this case in a grooved guide 34. The fastening part 23 can be guided via further or other surfaces in the housing 15. Furthermore, the slide 17 is shown, which is formed as a cap-shaped part and holds the bolt 28 between two arms 31. The bolt 28 can be displaced via a movement of the slide 17 along the wedge-shaped gap 29. The slide 17 is pre-tensioned in this case by a spring 32 in a starting position, in which the bolt 28 does not unlock the clamping lever 25. Unlocking of the clamping lever 25 is only caused by displacing the slide 17 against the force of the spring 32.

Furthermore, the unit 18 for lateral adjustment is shown, in which a threaded bolt 40 engages in a threaded borehole 41. A knurled nut 19 is fixed on the threaded bolt 40, wherein an edge of the knurled nut engages in a U-shaped receptacle 35 on the fastening part 23. By rotating the knurled nut 19, the fastening part 23 can therefore be displaced in relation to the housing 15 in the longitudinal direction of the threaded bolt 40, i.e., in a plane parallel to the front panel 6 of the drawer 4. During the lateral adjustment, the slide 17 is pivoted, since it is guided on one side on the housing 15 and on the other side via the bolt 28 on fastening part 23.

Figure 8C:
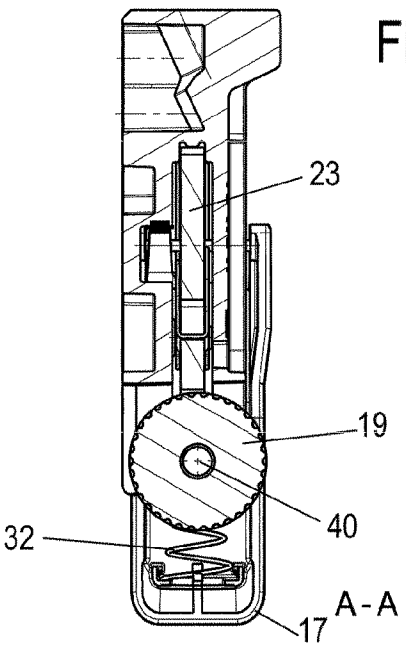
Figure 8B:
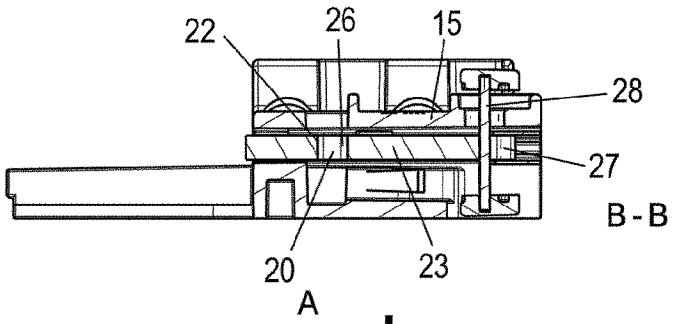
Figure 8A:
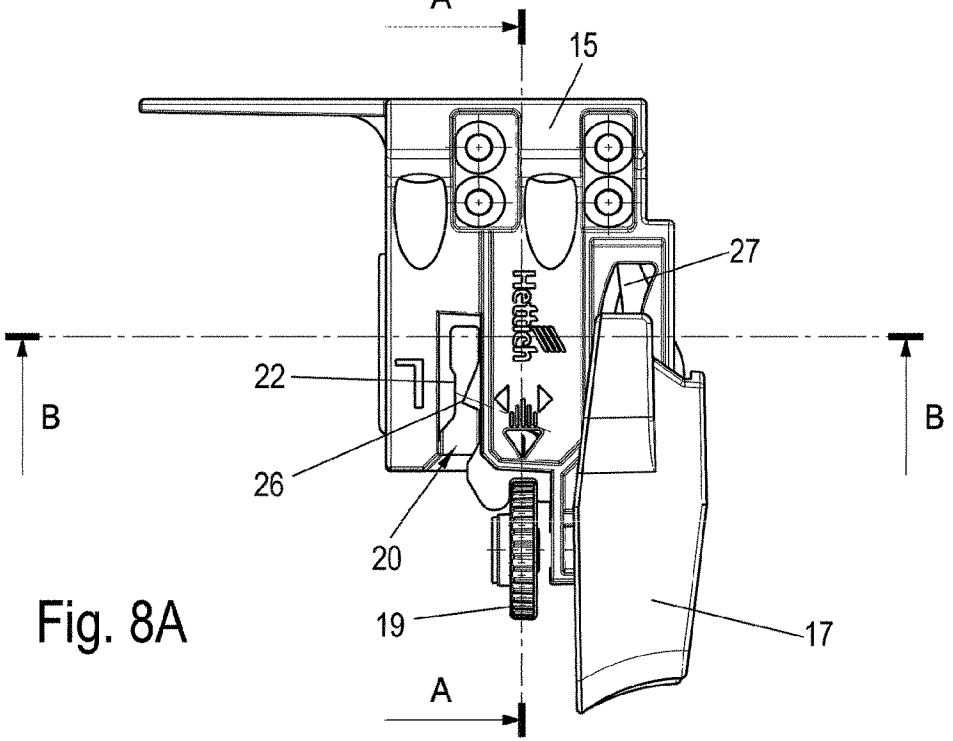

FIGS. 8A to 8C show the device 10 with the housing 15 in detail. The plate-shaped fastening part 23 is mounted so it is displaceable within the receptacle 33 of the housing 15 and in turn itself mounts the clamping lever 25 via the rotational axis 24. The slide 17 encloses the housing 15 in a U shape and is linearly guided, to pivot the clamping lever 25 for an unlocking procedure by way of a displacement.

Figure 9:
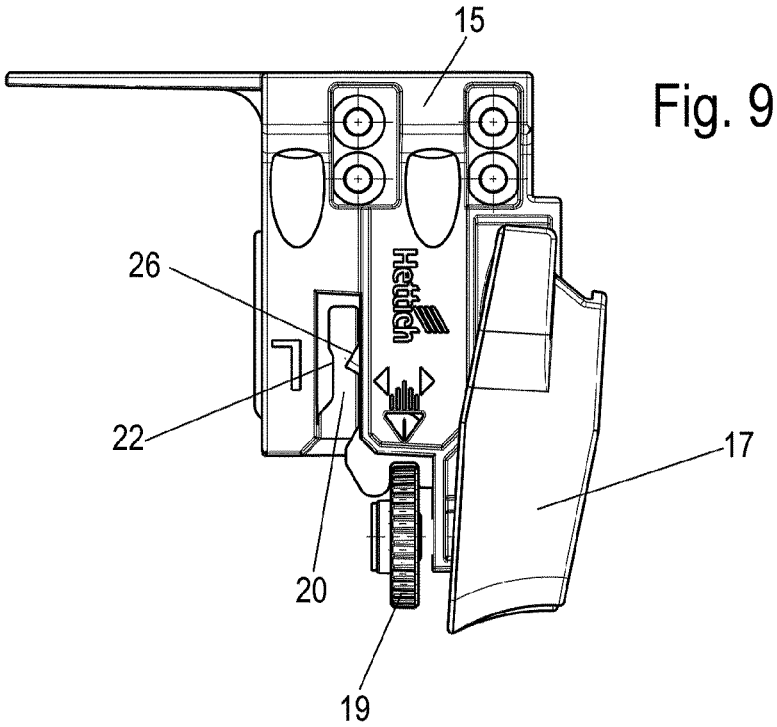

FIG. 9 shows the device 10 in an unlocked position, in which the slide 17 was pushed onto the housing 15. The bolt 28 thus moves the clamping lever 25, so that the contact surface 26 moves slightly away from the opposing side wall 22, so that a holding part 12, which is arranged between the side wall 22 and the contact surface 26, can be pulled out of the receptacle 20. The movement of the contact surface 26 can be in a range between 0.02 to 4 mm, in particular 0.4 mm to 2 mm.

Figure 10:
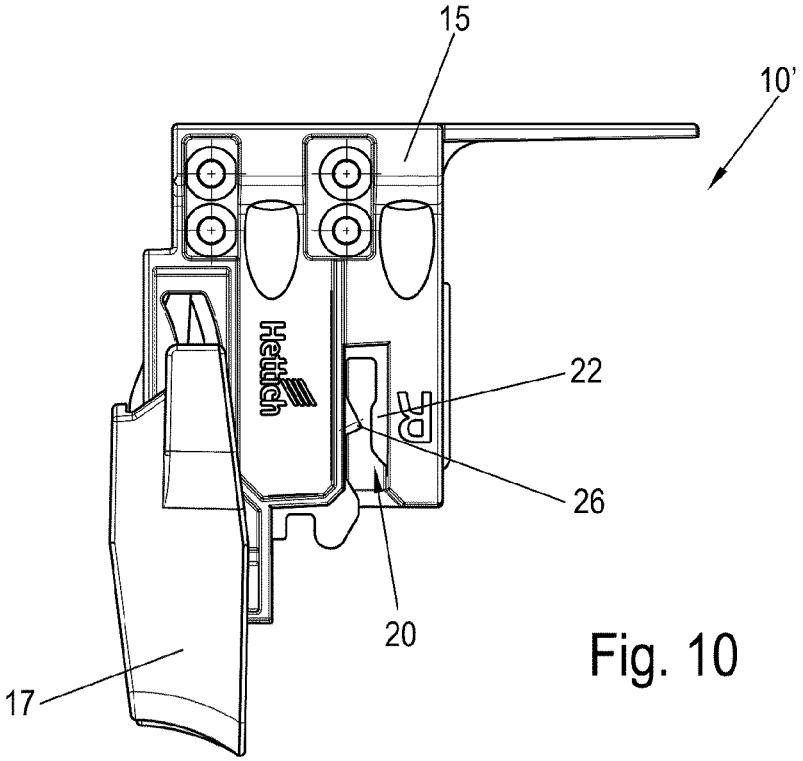
FIG. 10 shows a view of a modified device for fixing a push element without lateral adjustment.

FIG. 10 shows the device 10', which is designed like the device 10, but without the unit 18 for lateral adjustment. The knurled nut 19 and the threaded bolt 40 are thus absent, otherwise, the device 10' can be designed as structurally equivalent or mirror-symmetrical to the device 10. The fastening part 23 can be mounted so it is movable in the housing 15 in this case, so that the device 10' forms a movable bearing in the horizontal lateral direction, while a fixed bearing is provided on the opposite side, which positions the drawer 4 within the furniture body 2 in the horizontal lateral direction.

In the illustrated exemplary embodiment, both the clamping lever 25 and also the fastening part 23 consist of metal, in particular a steel plate. Particularly high holding forces can thus be applied to the holding part 12, which is also metallic.

Figure 11:
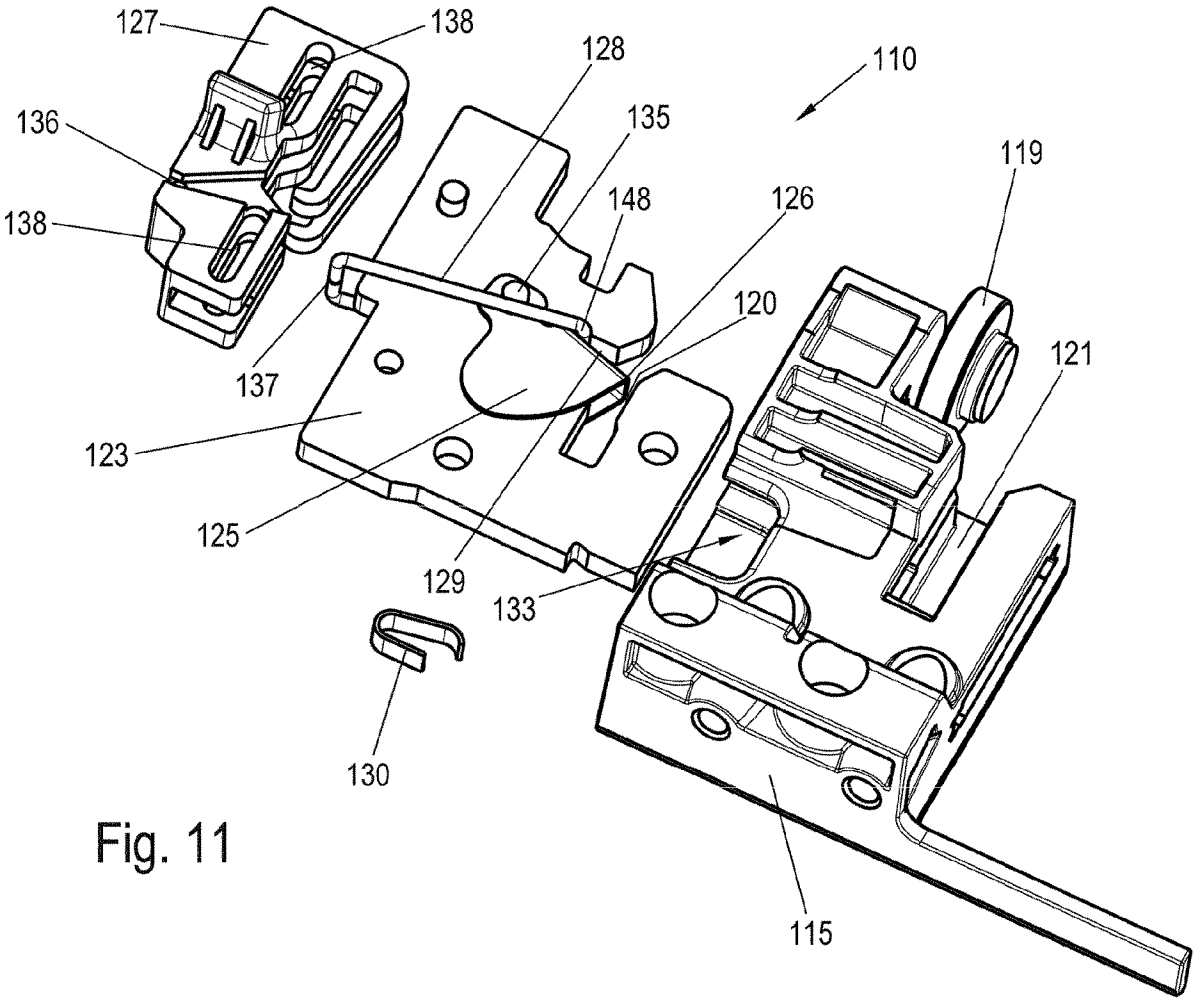
FIG. 11 shows a perspective exploded illustration of a modified device for fixing a push element without holding part.

FIG. 11 shows a further exemplary embodiment of a device 110 for fixing a movable furniture part, on which a receptacle 120 for receiving the holding part 112 is formed. The device 110 comprises a plate-shaped fastening part 123, on which the clamping lever 125 is mounted so it is rotatable about a rotational axis 124. The clamping lever 25 can also be fastened differently or can be embodied in one piece with the fastening part 123. If the clamping lever is not mounted so it is rotatable, the clamping lever can fulfill its function by bending. The clamping lever 125 is produced in this case from a bent metal plate, which encloses a section of the plate-shaped fastening part 123 in a U shape. A contact surface 126 is formed in this case on the bottom of the U, which presses as a linear contact against the holding part 112. The fixing of the holding part 112 can be performed as in the first exemplary embodiment (FIGS. 3 and 4).

Furthermore, a modified slide 127 is provided on the fastening part 123, which is used for unlocking the clamping lever 125. For this purpose, a holder 136 is provided on the slide 127, to receive a section 137 of a wire bow, which is used for unlocking the clamping lever 125. The wire bow is arranged on the opposite side with a section 148 in a wedge-shaped gap 129 between the clamping lever 125 and the fastening part 123. By pulling the traction element of the means 128 for unlocking the clamping lever 125, the clamping lever 125 can be moved against the force of a spring into the unlocked position. Oblong holes 138 are provided on the slide 127, which are penetrated by pins 139 to guide the slide 127 accordingly.

Figure 12A:
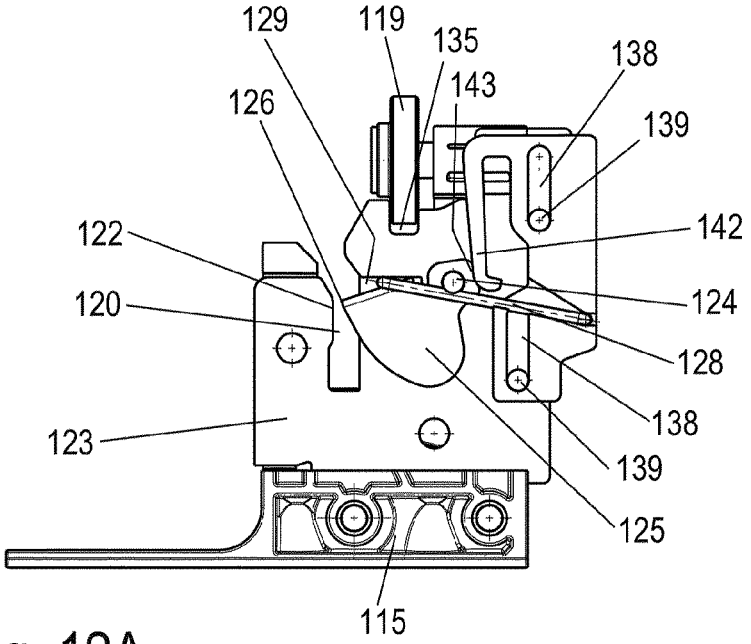
FIGS. 12A and 12B show two views of the device of FIG. 1 in the locked and unlocked positions.
Figure 12B:
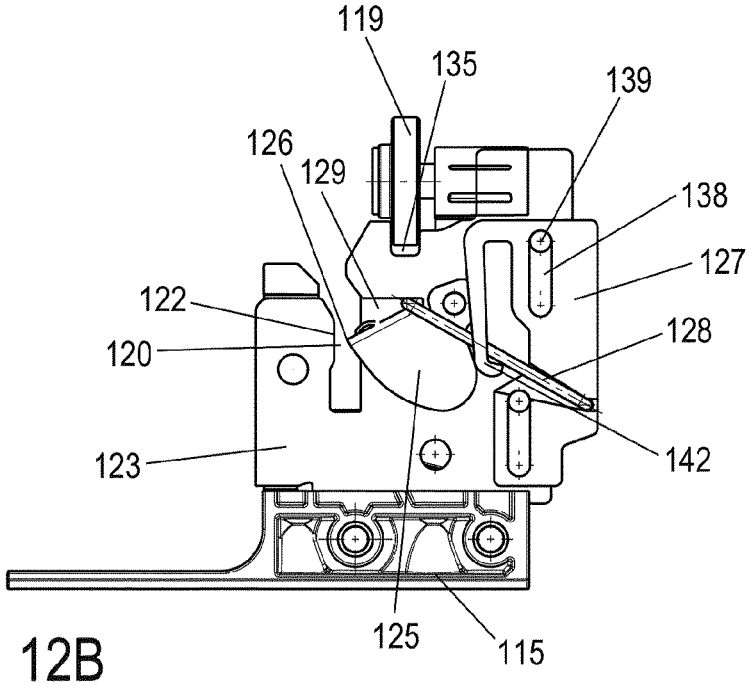

FIG. 12A shows the clamping lever 125 in the locked position, but without holding part 112. The slide 127 has spring elements 142, which are supported against a catch receptacle 143 on the clamping lever 125 and thus hold the slide 127 in its starting position. To unlock the clamping lever 125, the slide 127 is moved against the force of the spring elements 142 along the oblong holes 138 until the position shown in FIG. 12B is reached. The traction element of the means 128 for unlocking the clamping lever 125 is moved by the displacement of the slide 127, the traction element being moved along the gap 129 and thus having pivoted the clamping lever 125 counterclockwise. The gap between the contact 126 of the clamping lever 125 and the opposing side wall 122 is thus enlarged, so that the holding part 112 can be pulled out of the receptacle 120 nondestructively.

The plate-shaped fastening part 123 is inserted into a receptacle 133 on the housing 115. Furthermore, an opening 121 is formed in the region of the receptacle 120 on the housing 115. The fastening part 123 has a receptacle 135 for insertion of an edge section of the knurled nut 119, so that the fastening part 123 can be displaced in relation to the housing 115 for a lateral adjustment.

Figure 13:
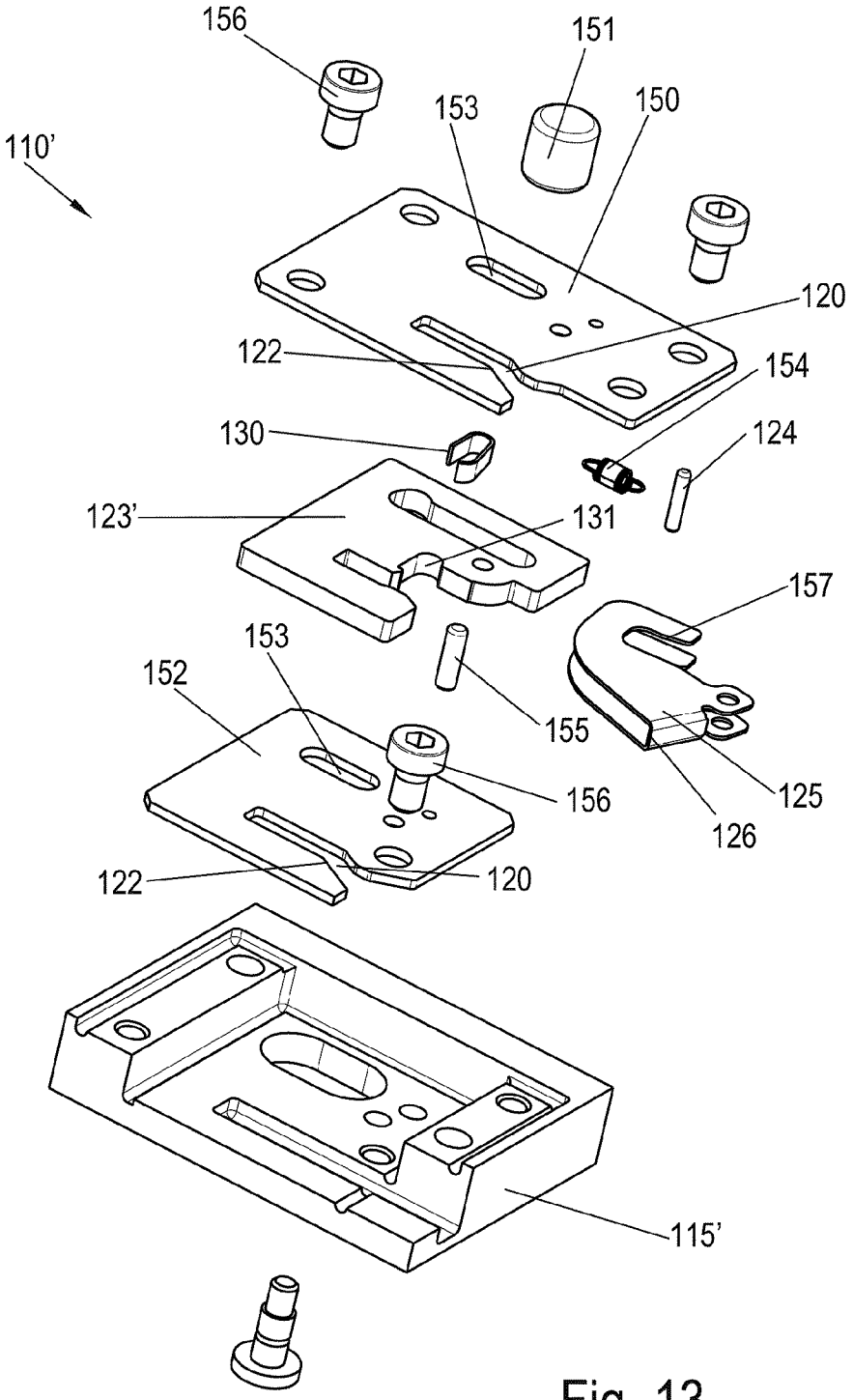
FIG. 13 shows a perspective exploded illustration of a modified device.

FIG. 13 shows a modified device 110', by means of which a wedge-shaped holding part 112 can be fixed by clamping. The device 110' comprises a housing 115', on which an outer plate 150 and an inner plate 152 are arranged. A slotted opening 120 is left out in the plates 150 and 152, in which a side wall 122 is arranged on one side and a clamping lever 125 is mounted so it is rotatable about a rotational axis 124 on the opposite side. The web-shaped holding part 112 can thus be fixed in a friction-locked manner between a surface 126 on the clamping lever and the side wall 122. Furthermore, oblong holes 153 are formed on the plates 150 and 152, which are used for guiding a pin, which is connected to a slide 151. The slide 151 is pre-tensioned in this case by a spring 154 in a starting position, wherein the spring 154 is fixed on one side on the slide 151 and on the other side on the plate 150.

The clamping lever 125 comprises an actuating arm 157, which can cooperate with the slide 151.

Furthermore, a receptacle 131 for inserting a spring 130, which is designed as a leaf spring and acts on the clamping lever 125 to pre-tension it in the locked position, is provided on the plate-shaped fastening part 123'.

Figure 14A:
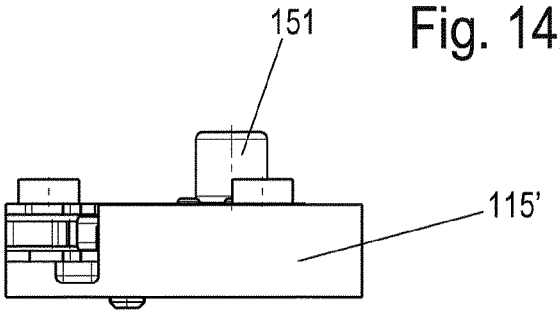
FIGS. 14A to 14C show multiple views of the device of FIG. 13.
Figure 14B:
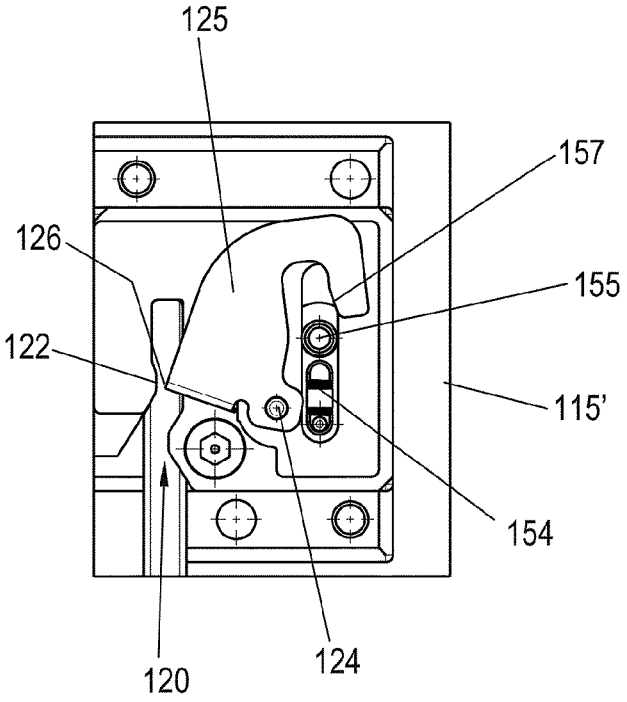
Figure 14C:
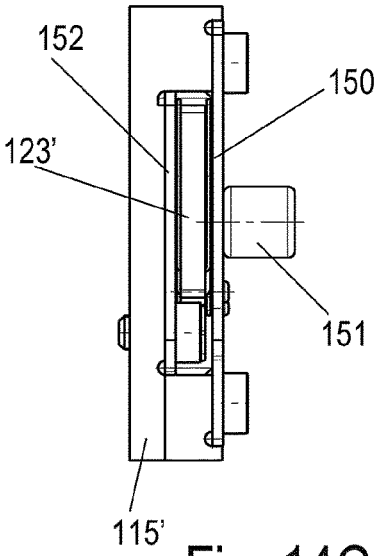

FIGS. 14A to 14C show the device 110' in the installed position. The slide 151 can be moved along the oblong holes 153 against the force of the spring 154, wherein the slide then acts on the actuating arm 157 of the clamping lever 125 to rotate it clockwise, so that a holding part 112, which is fixed in a friction-locked manner between the side wall 122 and the surface 126, can be unlocked. Other means can also be provided for unlocking the clamping lever 125. Both the clamping lever 125 and also the fastening part 123 can be produced from metal, in particular a steel plate.

Figure 15:
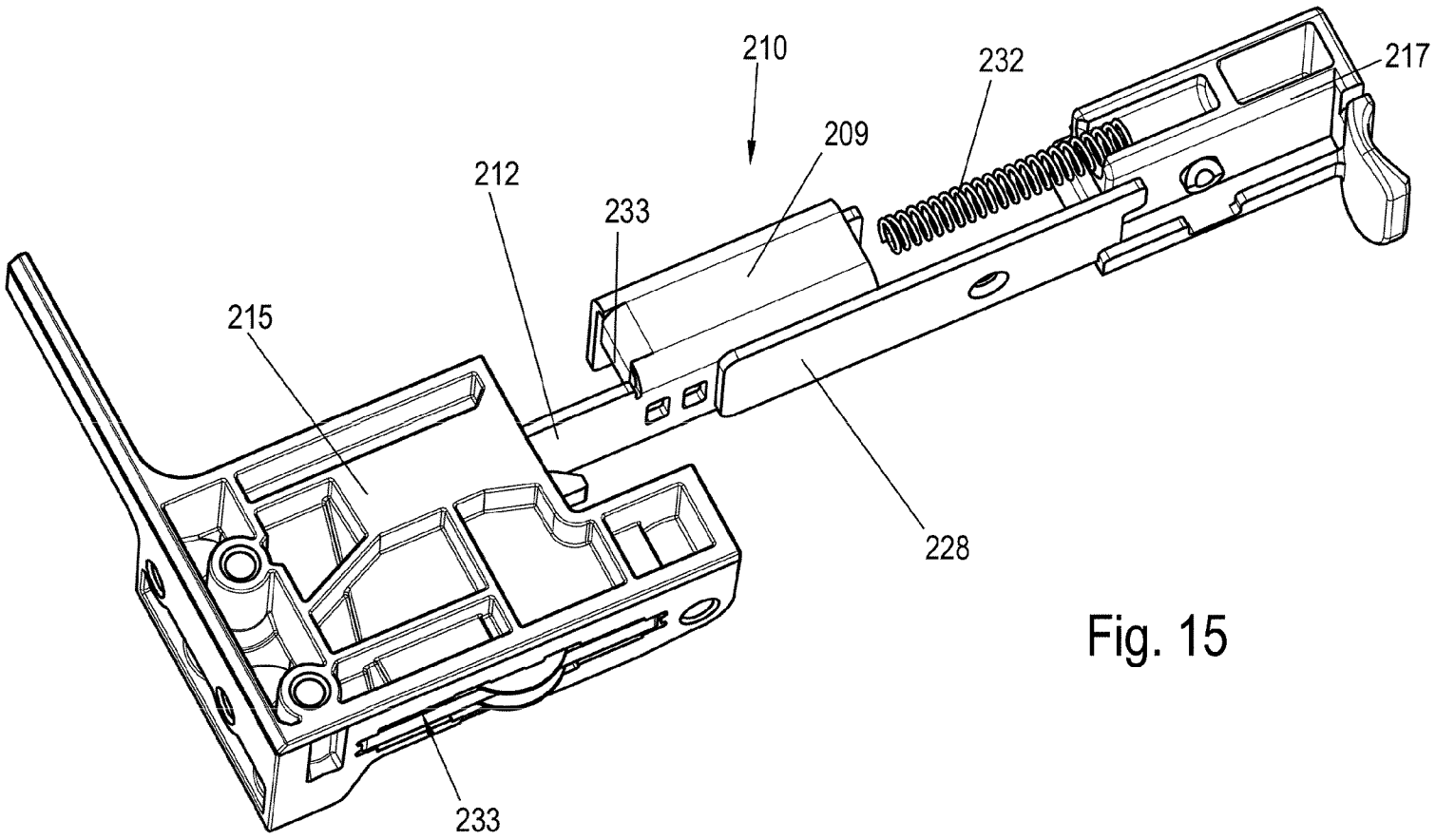
FIG. 15 shows a perspective exploded illustration of a modified device for fixing a push element.
Figure 16:
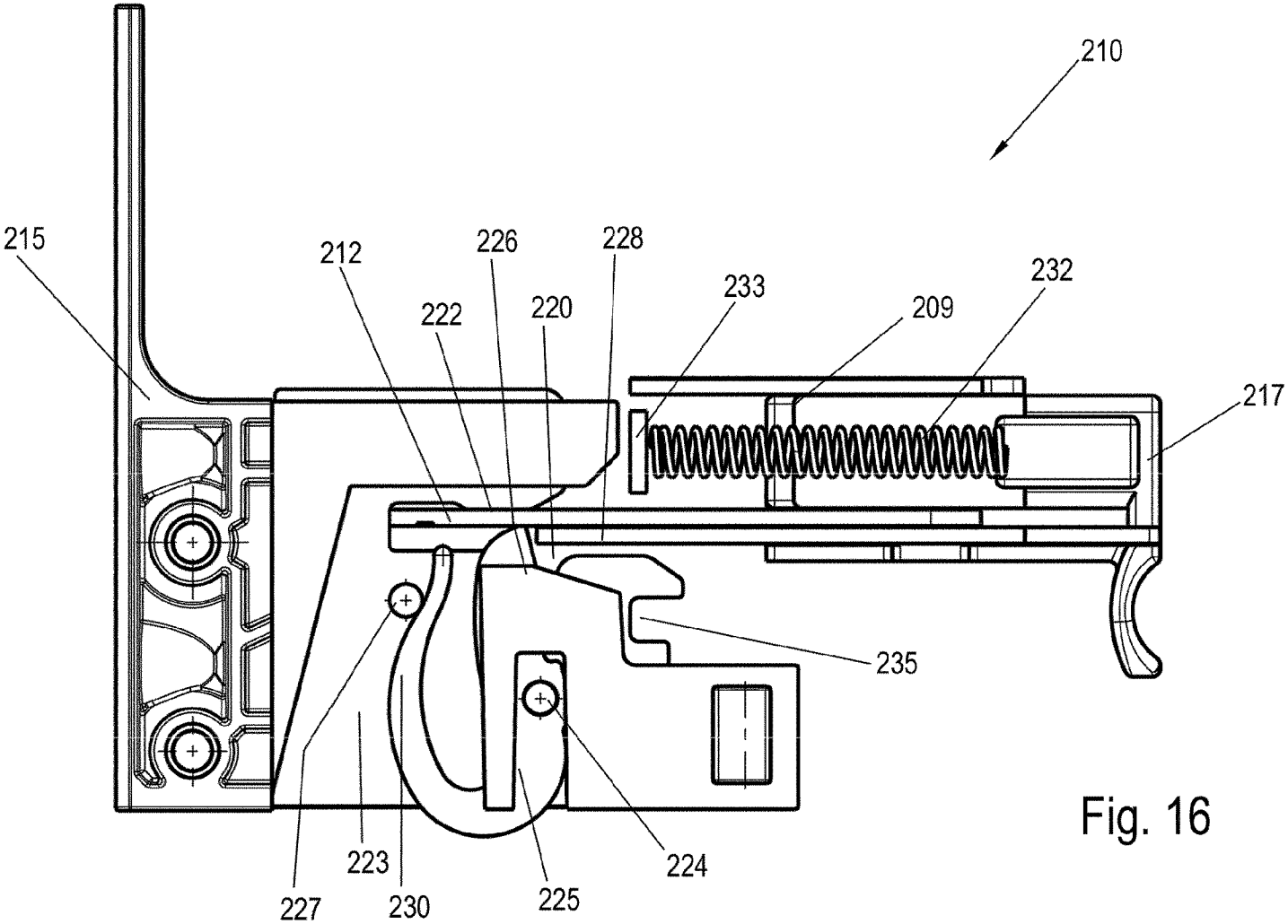
FIG. 16 shows a top view of the device of FIG. 15 without housing.

FIGS. 15 and 16 show a device 210 for fixing a movable furniture part. A housing 215 is fixed via fastening means on a lower side and/or a front panel of a drawer 4, wherein a receptacle 220 for inserting a holding part 212 is provided on the device 210. The holding part 212 can be fixed on a rail 5 of the pullout guide 3. In this case, the web-shaped holding part 212 can optionally be an integrally formed tab 9 on the rail 5, or can be fixed as at least one further component on the rail 5, or the holding part 12 is a part of the rail profile of the rail 5. A unit for depth adjustment can be provided on the web-shaped holding part 212, to set the insertion depth of the holding part 212 in the receptacle 220. Such a unit for depth adjustment can optionally also be omitted.

For the installation of the movable furniture part, the web-shaped holding part 212 is inserted into the receptacle 220 of the device 210 and fixed via a clamping mechanism, which secures the holding part 212 in a clamped and friction-locked manner against pulling out.

Outside the receptacle 220, in addition to the holding part 12, a linearly movable web 228 is provided, which is connected to a slide 217, which is pre-tensioned via a spring 232 in a starting position. The spring 232 is supported in this case on one side on the slide 217 and on the other side on a stop 233 on the tab 209.

As shown in FIG. 16, for the installation, the web-shaped holding part 212 is inserted into the receptacle 220 and secured therein against pulling out. For this purpose, a clamping mechanism is provided on the receptacle 220, which has a clamping lever 225 mounted so it is rotatable about a rotational axis 224. The clamping lever 225 has a contact surface 226 in this case, which can press in a friction-locked and/or non-positive manner against a lateral surface of the holding part 212. On the opposite side, the holding part 212 is supported by a side wall 222, which is formed on a plate-shaped fastening part 223, on which the clamping lever 225 is also mounted so it is rotatable. The clamping lever 225 has an integrally formed spring 230, which presses against a stop 227 to pre-tension the clamping lever 225 in the locked position. Upon insertion of the holding part 212, the lever 225 is pivoted against the force of the spring 230.

The clamping lever 225 is produced from a bent metal plate, which encloses a section of the plate-shaped fastening part 223 in a U shape. A contact surface 226 is formed in this case on the bottom of the U, which presses as a linear contact surface 226 against the holding part 212.

To disengage the clamping lever 225, the holding web 228 can be inserted via the slide 217 against the force of the spring 232 into the receptacle 220, whereby the clamping lever 225 in FIG. 16 is pressed counterclockwise and therefore lifts off of the holding part 212. In this position, the holding part 212 can thus be pulled out nondestructively from the receptacle 220.

Figure 17:
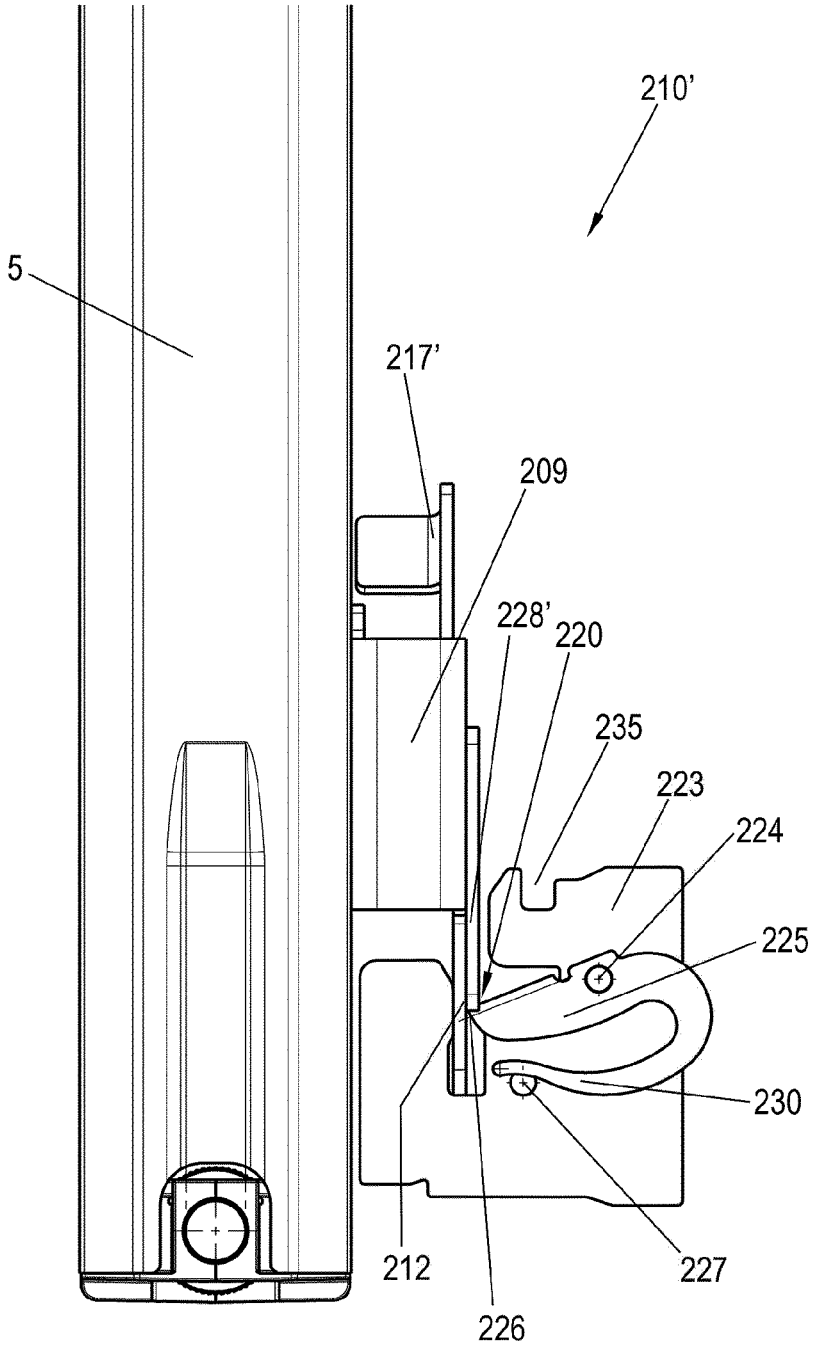
FIG. 17 shows a view of a modified device for fixing a push element without housing.
Figure 18:
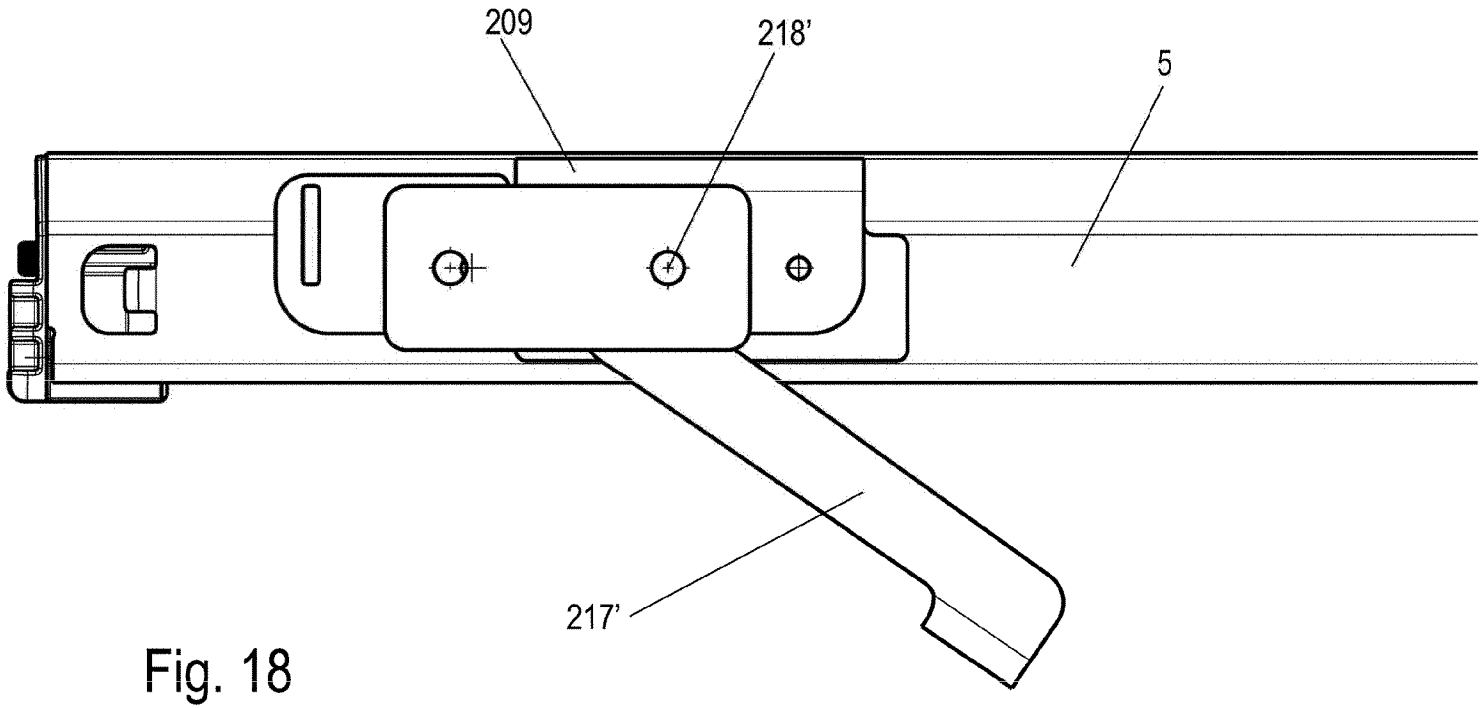
FIG. 18 shows a view of the device of FIG. 17 during the unlocking.

FIG. 17 shows a modified device 210' for fixing a drawer on a rail 5 of a pullout guide, in which a housing was blanked out. A web-shaped holding part 212 is inserted into the receptacle 220 as in the preceding exemplary embodiment and fixed therein in a friction-locked manner via the clamping lever 225, wherein the means for unlocking are not formed by a linearly movable slide 217, but rather a pivotable lever 217'. As the view of FIG. 18 shows, the lever 217' can be pivoted about the bearing pin 218', and thus move the clamping lever 225 into an unlocked position. The holding part 212 can thus be moved out of the receptacle 220 and the drawer can be disengaged from the pullout guide 5. The lever 217' is connected in this case to an unlocking element 228', which moves the clamping lever 225 accordingly.

Optionally, in the devices 210 or 210', a unit can be provided for lateral, height, and depth adjustment to adapt the front panel alignment. The unit for lateral adjustment can have a knurled nut, for example, which engages with an edge in a receptacle 235 and causes a housing to be moved laterally in relation to the receptacle 220 in the horizontal direction by rotating, as was already described above.

Figure 19:
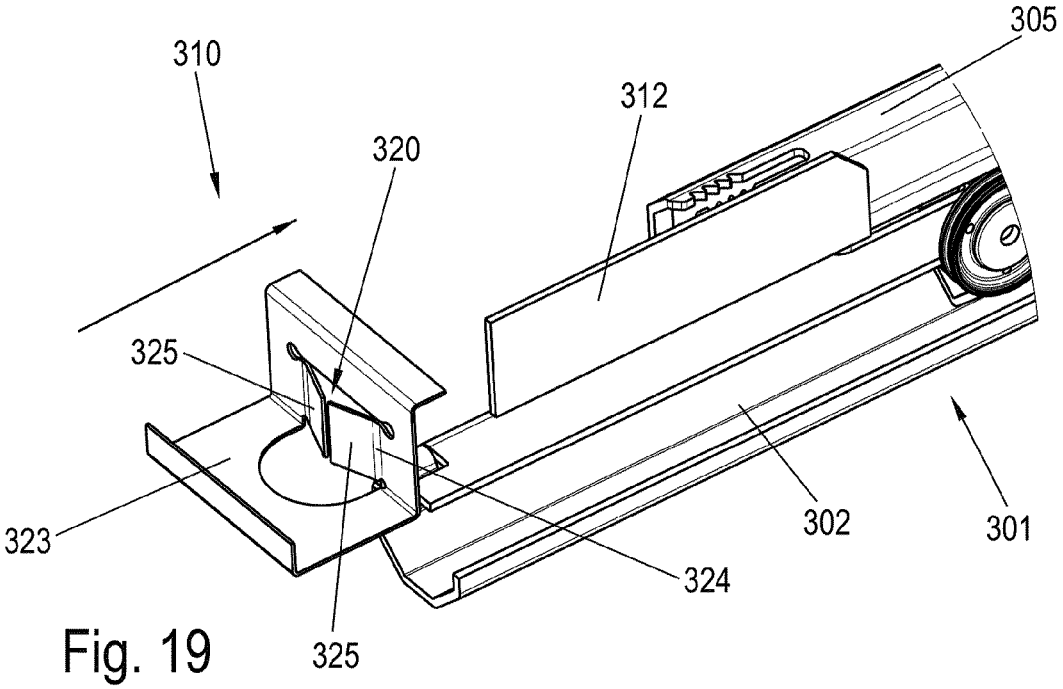
FIGS. 19 to 22 show views of a device according to the invention of a further advantageous embodiment.
Figure 20:
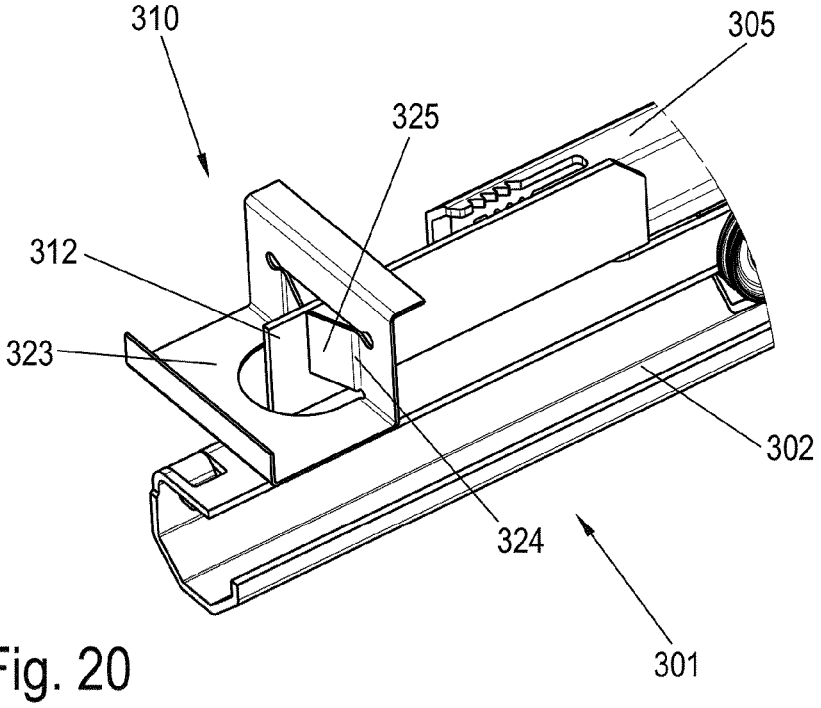

FIG. 19 shows a device 310 for fixing a movable furniture part, in which a receptacle 320 is formed on a fastening part 323. The receptacle 320 is formed in this case by a gap between two clamping levers 325 in the form of flaps, which are mounted so they are pivotable on the fastening part 323 via a bending edge 324. The clamping levers 325 are integrally formed with the fastening part 323 in this case, which is produced from a bent steel plate.

A holding part 312, which is formed as strip-shaped and can also consist of a steel plate, can be fixed on the receptacle 320. The holding part 312 is fixed on a movable slide rail 305 of a pullout guide 301, for example, by welding. The pullout guide 301 comprises a stationary guide rail 302, which can be fixed on a furniture body. The holding part 312 can also be fixed, however, on another furniture part, for example, a sliding door or on a stationary furniture body.

Figure 21A:
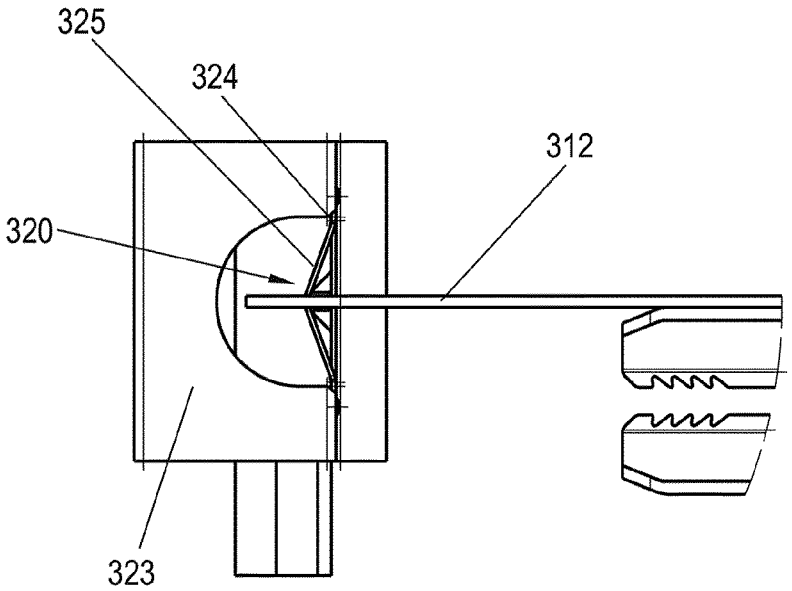
Figure 21B:
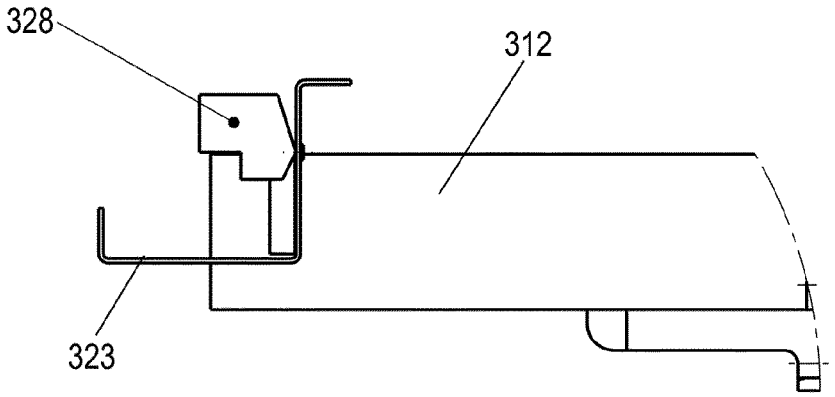

For the installation of the web-shaped holding part 312, it is inserted into the receptacle 320 and fixed via the clamping mechanism having the two clamping levers 325, which secure the holding part 312 in a clamped and friction-locked manner against pulling out (FIGS. 21A and 21B). Optionally, additional springs can be provided, to pre-tension the clamping levers 325 in the locked position, however, a pre-tension of the clamping levers 325 in the locked position is also already caused by bending the clamping levers 325 during insertion of the holding part 312.

Figure 22A:
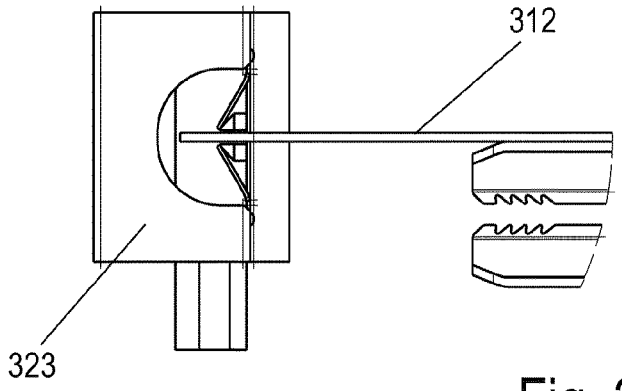
Figure 22B:
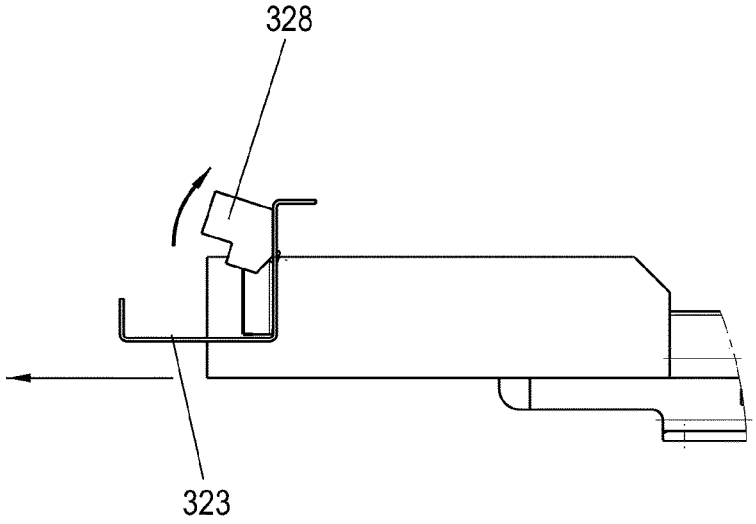

For unlocking of the clamping mechanism, an unlocking element 328 is provided, which can easily move the clamping levers 325 formed as flaps in the opening direction. For this purpose, the unlocking element 328 is mounted so it is pivotable on the fastening part 323, as is recognizable from FIGS. 22A and 22B. The unlocking element 328 can also be guided so it is movable on a curve guide or in another manner, to act on the clamping levers 325.

In all exemplary embodiments, only one installation direction is shown. The device can be designed with further clamping mechanisms so that the movable furniture part can be displaced in the desired depth, height, and/or laterally, and then fixed.

LIST OF REFERENCE NUMERALS

1 furniture
2 furniture body
3 pullout guide
4 drawer
5 rail
6 front panel
7 bottom
9 tab
10, 10' device
11 unit
12 holding part
13 knurled nut
14 threaded bolt
15 housing
16 fastening means
17 slide
18 unit
19 knurled nut
20 receptacle
22 side wall
23 fastening part
24 rotational axis
25 clamping lever
26 surface
27 arm
28 bolt
29 gap
30 spring
31 arm
32 spring
33 receptacle
34 guide
35 receptacle
40 threaded bolt
41 threaded borehole
110 device
115 housing
117 slide
119 knurled nut
120 receptacle
121 opening
122 side wall
123, 123' fastening part
124 rotational axis
125 clamping lever
126 surface
127 slide
128 means for unlocking
129 gap
130 spring
131 receptacle
133 receptacle
135 receptacle
136 mount
137 section
138 oblong holes
139 pin
142 spring element
143 catch receptacle
148 section
150 plate
151 slide
152 plate
153 oblong holes
154 spring
157 actuating arm
210, 210' device
212 holding part
215 housing
217 slide
217' lever
218' bearing pin
220 receptacle
222 side wall
223 fastening part
224 rotational axis
225 clamping lever
226 surface
227 stop
228 holding web
228' unlocking element
230 spring
232 spring
233 stop
235 receptacle
301 pullout guide
302 guide rail
305 slide rail
310 device
312 holding part
320 receptacle
323 fastening part
324 bending edge
325 clamping lever
328 unlocking element

What is claimed is:

1. A device for fixing a movable furniture part on a component (5) of a fitting (3), comprising a clamping mechanism having a receptacle (20, 120, 220, 320), and a web-shaped holding part (12, 112, 212, 312) having flat side surfaces, the web-shaped holding part being insertable into said receptacle, wherein a self-locking rotatable clamping lever (25, 125, 225, 325) is provided on the receptacle (20, 120, 220, 320), and wherein the holding part (12, 112, 212, 312) is secured against pulling out by the clamping lever and a side wall of the receptacle gripping the flat side surfaces of the web-shaped holding part in a friction-locked manner.

2. The device according to claim 1 wherein the clamping lever (25, 125, 225, 325) is pre-tensioned in the locked position.

3. The device according to claim 1, wherein devices for unlocking (28, 128, 228, 328) the clamping lever (25, 125, 225, 325) are provided, by which the friction-locked connection of the clamping lever (25, 125, 225, 325) can be disengaged from the holding part (12, 112, 212, 312).

4. The device according to claim 3, wherein the device for unlocking the clamping lever comprises a linearly movable slide (17).

5. The device according to claim 1, wherein the clamping lever (25, 125, 225, 325) is designed as a two-armed lever and a first arm presses with a contact surface (26, 126, 226, 326) against the holding part (12, 112, 212, 312) and a second arm is movable via a device (28) for unlocking the clamping lever (25, 125, 225, 325).

6. The device according to claim 1, wherein the clamping lever (25, 125, 225, 325) presses via a linear contact surface (26, 126, 226, 326) against the holding part (12, 112, 212, 312), which extends in parallel to a rotational axis (24) of the clamping lever (25, 125, 225, 325).

7. The device according to claim 1, wherein the holding part (12, 112, 212, 312) is continuously fixable on the clamping mechanism.

8. The device according to claim 1, wherein a surface of the clamping lever (23) pressing against the holding part (12, 112, 212, 312) and the holding part (12, 112, 212, 312) are produced from metal.

9. The device according to claim 1, wherein a rotational axis (24) of the clamping lever (25, 125, 225, 325) is arranged in front of a contact surface (26, 126, 226, 326) of the clamping lever (25, 125, 225, 325) on the holding part (12, 112, 212, 312) in an insertion direction.

10. The device according to claim 1, wherein the receptacle (20, 120, 220, 320) is formed on a fastening part (23), on which the clamping lever (25, 125, 225, 325) is mounted so it is rotatable.

11. The device according to claim 10, wherein the fastening part (23) is mounted so it is displaceable on or in a housing (15).

12. The device according to claim 11, wherein the fastening part (23) is moved via (19) a device for lateral adjustment in relation to the housing (15).

13. The device according to claim 1, wherein the clamping lever (325) has bendable clamping elements.

14. The device according to claim 1, wherein a fastening part (23, 123, 223, 323) is provided, on which the clamping lever (25, 125, 225, 325) is indirectly or directly arranged, or the clamping lever (25, 125, 225, 325) is embodied in one piece with the fastening part (23, 123, 223, 323).

15. The device according to claim 1, further comprising the movable furniture part and the fitting, wherein at least one adjustment device is provided, which adjusts the movable furniture part (4) in relation to the fitting (3) in at least one spatial direction.

16. The device according to claim 1, further comprising the movable furniture part, wherein multiple clamping mechanisms are provided, to align the movable furniture part in an alignment position.

17. The device according to claim 16, wherein a stop of an adjustment unit limits an insertion depth of the clamping mechanism.

18. The device according to claim 17, wherein the relative location of the movable furniture part in relation to the fitting is settable by the adjustment unit.

19. An item of furniture (1) comprising a furniture body (2) and at least one movable furniture part (4), which is held so it is movable on the furniture body (2) via at least two fittings (3), and at least one fitting (3) is connected via the device according to claim 1 to the movable furniture part (4).

20. A method for aligning a movable furniture part on a component (5) of a fitting (3) in a furniture part, the movable furniture part comprising at least one clamping mechanism having a receptacle (20) and at least one web-shaped holding part (12) on the component (5), the web shaped holding part having flat side surfaces and at least one adjustment unit for the movable furniture part (4), the method comprising the steps of placing the movable furniture part on the fitting, pushing the movable furniture part up a setting position on the furniture part such that the flat side surfaces of the at least one web-shaped holding part are clamped in a friction locked manner between a side wall of the receptacle and a clamping lever of the clamping mechanism, and setting the adjustment unit so that the clamping mechanism cannot be pushed further onto the holding part.

21. The method according claim 20, wherein the pushing-on direction is used for alignment of at least one spatial direction.

* * * * *